US005349789A

United States Patent [19]

Andert et al.

[11] Patent Number: 5,349,789

[45] Date of Patent: Sep. 27, 1994

[54] MULTI-LEVEL FOLDING STAGE

[75] Inventors: Gary W. Andert, Rosemount; Rollin D. Botts, Bloomington; Andrew J. Shea, Eden Prairie, all of Minn.

[73] Assignee: Sico Incorporated, Minneapolis, Minn.

[21] Appl. No.: 923,368

[22] Filed: Jul. 31, 1992

Related U.S. Application Data

[63] Continuation-in-part of Ser. No. 743,154, Aug. 9, 1991, Pat. No. 5,325,640.

[51] Int. Cl.[5] ..... E04H 3/12; E04H 3/22

[52] U.S. Cl. ..... 52/7; 52/8; 52/9

[58] Field of Search ..... 52/7, 8, 9

[56] References Cited

U.S. PATENT DOCUMENTS

| | | | |
|---|---|---|---|
| D. 304,499 | 11/1989 | Rogers et al. . | |
| D. 307,186 | 4/1990 | Rogers et al. . | |
| 2,978,754 | 4/1961 | Wilson . | |
| 3,080,833 | 3/1963 | Risdall . | |
| 3,351,029 | 11/1967 | Bue . | |
| 3,476,061 | 11/1969 | Takahashi . | |
| 3,999,491 | 12/1976 | Wilson . | |
| 4,026,221 | 5/1977 | Wilson . | |
| 4,054,096 | 10/1977 | Wilson et al. . | |
| 4,074,636 | 2/1978 | Wilson . | |
| 4,104,835 | 8/1978 | Bardwick, III . | |
| 4,301,627 | 11/1981 | Wilson . | |
| 4,327,650 | 5/1982 | Bue . | |
| 4,570,751 | 2/1986 | Kleu | 182/131 |
| 4,638,604 | 1/1987 | Rogers et al. | 52/6 |
| 4,779,542 | 10/1988 | Staten et al. . | |
| 4,811,530 | 3/1989 | Eyerly . | |
| 4,843,792 | 7/1989 | Rogers et al. | 52/127.7 |
| 4,845,915 | 7/1989 | Rogers et al. | 52/783 |
| 4,863,126 | 9/1989 | Rogers et al. . | |
| 4,872,295 | 10/1989 | Fujita . | |
| 4,917,217 | 4/1990 | Rogers et al. . | |
| 4,934,113 | 6/1990 | Hall et al. . | |
| 4,949,649 | 8/1990 | Terres et al. . | |
| 4,979,340 | 12/1990 | Wilson et al. | 52/9 |
| 5,050,353 | 9/1991 | Rogers et al. | 52/8 |

FOREIGN PATENT DOCUMENTS

| | | |
|---|---|---|
| 1055079 | 5/1979 | Canada . |
| 0389932 | 10/1990 | European Pat. Off. . |
| 2637215 | 7/1976 | Fed. Rep. of Germany . |
| 2314315 | 1/1977 | France . |
| 2418319 | 9/1979 | France . |
| 2554476 | 5/1985 | France . |
| 2587784 | 12/1987 | France . |
| 1277474 | 8/1985 | Japan . |
| 16090 | 6/1983 | Philippines . |
| 76348 | 5/1982 | Romania . |
| 1526323 | 7/1976 | United Kingdom . |

*Primary Examiner*—Carl D. Friedman
*Assistant Examiner*—Christopher Todd Kent
*Attorney, Agent, or Firm*—Merchant, Gould, Smith, Edell, Welter & Schmidt

[57] ABSTRACT

An elevationally adjustable folding stage has a frame which folds along a center of the stage from a storage position to a use position. Stage panels of interchangeable widths form a stage surface and are reversible and interchangeable. The stage may also support additional panels between stages extending therefrom to form an extended stage surface. The stage has a roller assembly which lifts the stage up so that rollers engage the floor for rolling between storage and use locations. Connectors between the frame and the stage offer quick connection without additional pieces. Connectors also provide for inserting risers to raise the height of one panel of the stage relative to the other. In addition to the risers, multi-panel supporting bases may be used to support the panels extending from the edges of the stage between stages. The panels between the stages may be stored on the stage while in the use or folded position by hook members which rotate from a storage to a use position to retain the additional panels. Folding of the stage is assisted by a spring folding assist member which prevents closing of the stage and assists in the initial opening of the stage toward the folded position. Accidental folding of the stage is also prevented by a locking linkage and a spacing linkage which lock the stage in the use position to prevent accidental folding and also to maintain the stage in the use position when elevationally adjusting the stage panels.

17 Claims, 20 Drawing Sheets

MULTI-LEVEL FOLDING STAGE

This application is a continuation-in-part of U.S. application Ser. No. 07/743,154, filed Aug. 9, 1991 now issued as U.S. Pat. No. 5,325,640.

BACKGROUND OF THE INVENTION

1. Field of the Invention

The present invention relates to the field of mobile elevationally-adjustable folding stages which also support panels placed between stages for an extended stage surface.

2. Description of the Prior Art

Folding stages are used for a variety of purposes to provide a temporary raised platform for use in schools, hotels, convention centers and other institutions wherein multiple use facilities require the capability of setting up temporary stages. Such stages are made up of individual stage structures which are positioned adjacent each other to form an extended stage surface or are positioned to support bridge panels between the stages to form an extended stage surface. When not in use, the individual stage structures may be folded to compact dimensions and stored along with the bridge panels. The stages typically have two stage surface members hinged together to provide for folding action, and have legs which either fold out of the way or remain vertical while the stage panels fold.

An example of such a folding stage is shown in U.S. Pat. No. 4,949,649 to Terres et al. Although the stage shown in the Terres patent is very successful in providing efficient and useful folding stages, further improvements are still possible, particularly with regard to stages having expandable areas which also fold for storage. Folding stages require a lock so that the stage panels remain securely in place forming a continuous stage surface and so that the stages do not fold inadvertently. The center lock of the Terres patent requires a relatively complicated mechanism which is spring loaded and aligns between the two panels of the folding stage. The present invention provides for locking of the two sides of the stage at an accessible location with an inexpensive simple mechanism. The present invention also provides for utilizing either two or three stage surface panels for greater flexibility.

Previous folding stages have heretofore not provided for satisfactorily supporting bridging panels between the frameworks of the stages to form an extended stage surface. Extensible area stages have not provided for folding of the frameworks of each stage. In addition, there has been no storage for the bridging panels on the stages' framework.

Portable stages often have wheel assemblies which can be pivoted about a frame member into engagement with the floor to lift the supporting legs off the floor so that the stage will roll. However the wheel assemblies are located near the ground with handles also located near the ground for rotating the wheel assemblies between positions. Actuation of the low handles requires bending over by workers attempting to engage or release the legs. The accessibility is limited, as the handle is typically underneath the stage surface so that in addition to bending over, the worker must move underneath the stage panels to move the wheel assemblies between positions. Therefore, it is advantageous to provide wheel assemblies which provide a mechanical advantage and also provide for engaging and disengaging the wheels with the handle easily accessed in all positions.

Although prior folding stages are elevationally adjustable, prior stages have not provided for adjusting the height of one panel of a folding stage relative to the other panel and have been limited to two panel arrangements. Such adjustment would provide for forming choral riser-type formations with a single folding stage. Prior stages also have not provided for forming choral riser type formations which provide for bridging panels between stage frameworks.

Methods for attaching panels to the framework so that the panels may be easily attached or may be reversed heretofore have required connectors inserting through passages in the panels and which had loose separate top portions which were detachable from the stage and could be lost or misplaced. The connectors also require a groove in the stage panel passage to engage the connector for locking the panel into position.

It may be seen then, that there is a need for a folding stage which provides for reversible panels which are secured in an improved manner with no extra loose parts. It can also be seen that a stage is required which has easy access for locking and unlocking a stage into position and for engaging wheel assemblies. Storing and handling of stage panels supported between stage frames must be stored in an easy, economical fashion on the existing frameworks. Folding stages should also have the ability to adjust the height of one stage panel relative to an adjacent stage panel so that choral riser configurations may be achieved. The present invention addresses these as well as other problems associated with folding stages.

SUMMARY OF THE INVENTION

The present invention is directed to folding stages which may be used to set up temporary elevated platforms. The present invention has stage panels supported by a folding frame. The frame folds from a use position wherein the panels are horizontal and form a stage surface to a folded position wherein the frame takes up less area and the stage panels are substantially facing one another.

The present invention provides for connecting and removing stage panels from the framework and for reversing the panels. Connectors extend through openings in the stage panels to frictionally engage the openings to secure the panels in place. In addition, panels which bridge between the stages to form an extended stage surface may be stored on top of the panels of the stage with hook members which retain the panels. The hook members rotate out of view and underneath the stage panels when not used for retaining the extra bridging panels.

The connectors of the present invention also provide for supporting the bridging panels which form an extended stage surface between the stages off of two sides of the stage or supporting three panels adjacent a corner of the stage. By having supports with multi-connectors positioned thereon, the various panels may be supported between the stages.

The stage panels may also be elevated relative to one another on a single stage by inserting risers below the connectors. Various heights of risers may be inserted on top of the frame and below the connector to elevate one panel relative to another, thereby forming a choral riser type structure. In addition, the present invention provides for a choral riser type structure which has either two or three panels. In addition, the choral riser structure may be bridged between stage frames and nested to form extended risers with multiple heights.

The stages fold between a use position wherein the panels are substantially horizontal and a storage position wherein the panels are substantially facing one another. When in the use position, the stage must be maintained so that it does not fold from pressures at the edges of the stage. The present invention provides for a locking linkage extending between the legs underneath each panel to space the legs apart from one another. The locking linkage can be easily accessed and snapped into position with a worker's foot by stepping on the linkage and easily kicking out the linkage to disengage. The locking linkage works with a spacing linkage extending between one set of legs which maintains the distance between the legs so that the stage does not fold during elevational adjustment.

In addition to the locking linkage for maintaining the stage in the use position, the present invention provides for folding assistance. A spring-supported folding stanchion engages the stage during the final motion of folding to the use position. The folding stanchion acts as a cushioning device so that the weight of the stage does not slam the stage into the fully-open position. This prevents pinching of hands or fingers which may be caught between the folding members of the stage. The spring of the folding stanchion also provides constant force against the folding framework of the stage to aid in starting the motion of folding the stage to the storage position.

The present invention also provides roller assemblies which ease transporting of the stage between storage and use positions. The roller assemblies have rollers which can be raised and lowered to engage the floor. Each roller assembly uses a pivoting linkage to pivot the rollers up and down from a position wherein they are fully lifted from the floor so that the legs of the stage engage the floor and a lowered position wherein the legs are lifted from the floor and the rollers engage the floor. A rotating handle which rotates from a storage position where it is hidden below the stage panels to a position where it is easily grasped provides mechanical advantage so that a single person can easily raise and lower the roller assemblies from the fully raised to fully lowered position.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals designate corresponding elements throughout the several views.

DETAILED DESCRIPTION OF THE PREFERRED EMBODIMENT(S)

Figure 1:
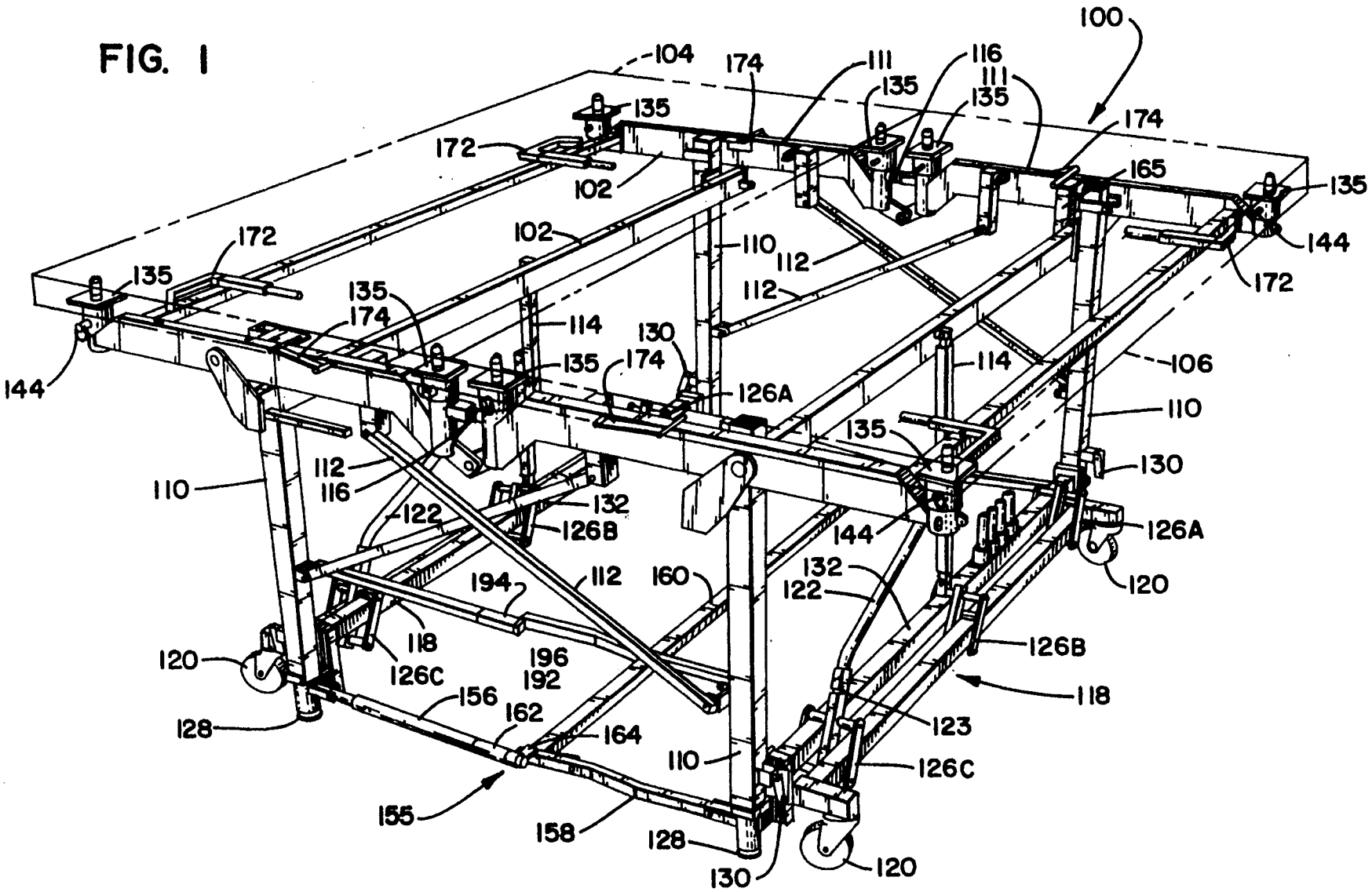
FIG. 1 shows a perspective view of an unfolded stage according to the principles of the present invention.
Figure 2:
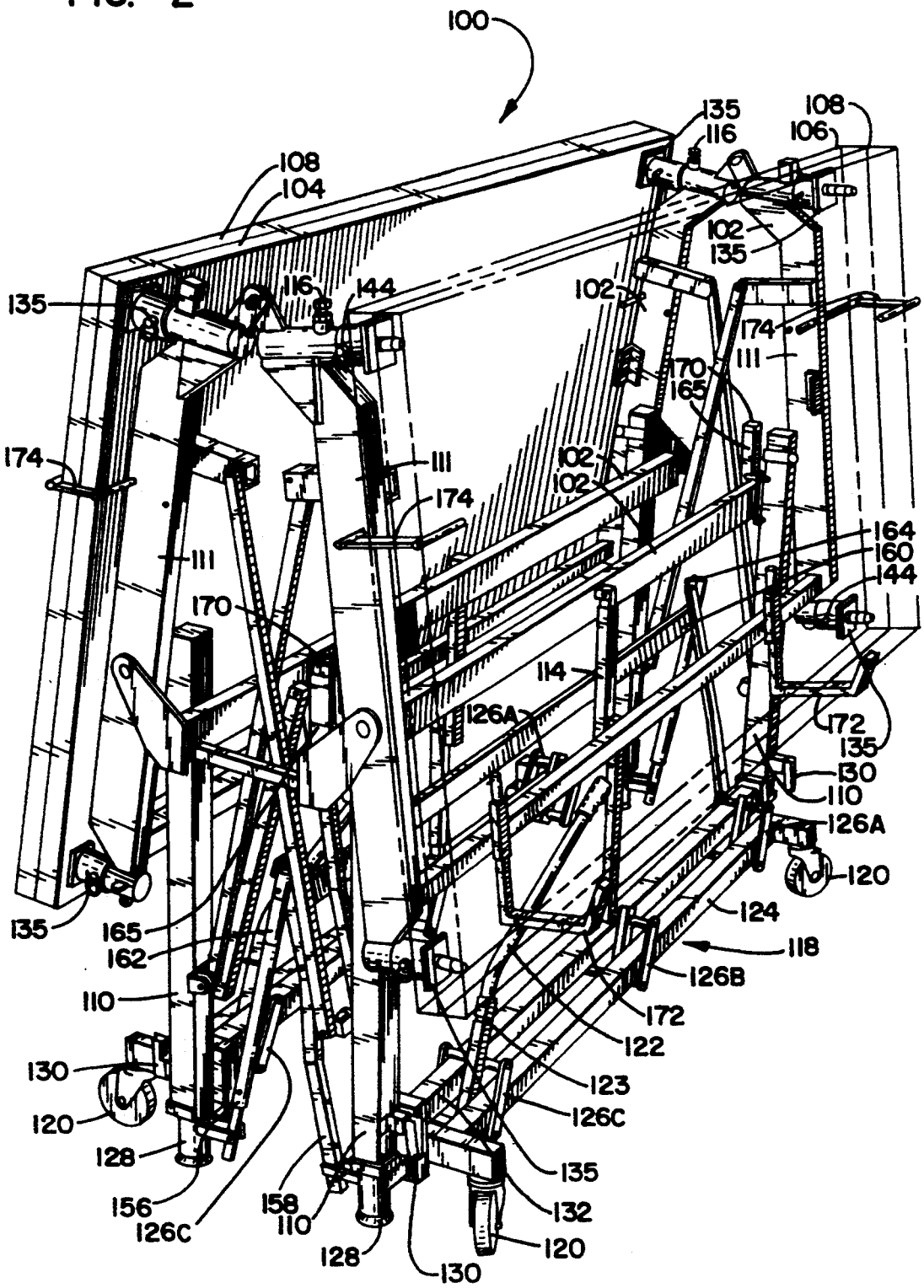
FIG. 2 shows a perspective view of the stage shown in FIG. 1 in a folded storage position and having stage panels stored thereon.

Referring now to the figures, and in particular to FIG. 1, there is shown an elevationally adjustable folding stage 100 in an unfolded, ready-for-use position. The stage supports a pair of panels 104 and 106 on a framework 102. The frame 102 folds to a storage position as shown in FIG. 2 wherein the panels 104 and 106 are substantially facing one another and the overall area taken up by the stage is substantially reduced. The panels 104 and 106 are reversible and may have different surfaces on each face, such as carpet or non-skid surfaces. The framework 102 has a folding portion 111 connecting at a center hinge and a folding linkage 112 which maintain legs 110 substantially upright when in the folded or unfolded position and during folding. The height of the stage 100 can be varied with telescoping members 128 extending from the legs 110 which can be raised or lowered to obtain a desired height of the stage 100 and which are adjusted by releasing height adjustment levers 130. The telescoping legs 128 have pads which engage the floor. Raising and lowering and folding the stage 100 is assisted by gas springs 114 which are sized to the weight of the stage 100. In addition, adjustments can be made so that the panels 104 and 106 align by adjusting bolt 116 at the center of the folding portion of the frame 102.

Figure 4:
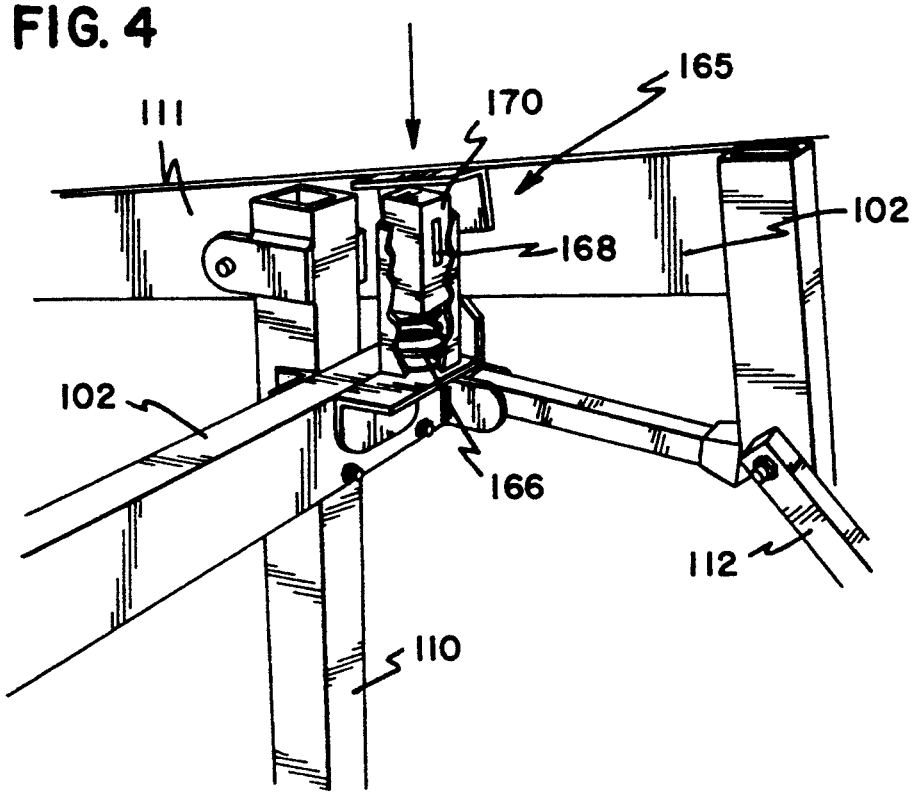
FIG. 4 shows a folding assist apparatus shown in FIG. 3 with the stage in a partially-folded position.
Figure 3:
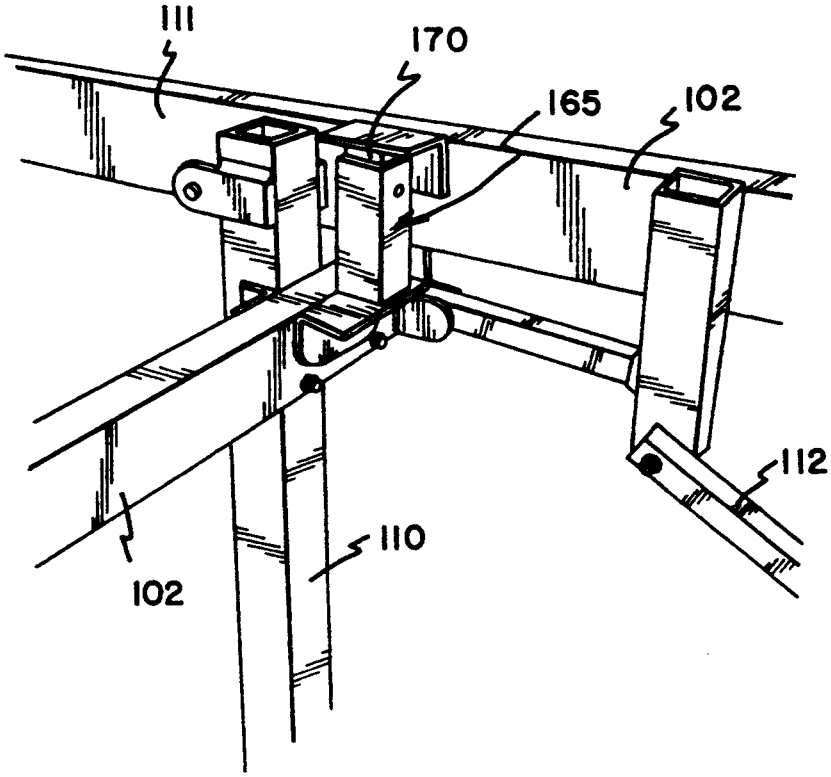
FIG. 3 shows a side partial sectional view of a folding assist apparatus for the stage shown in FIG. 1 with the stage in the fully unfolded position.

As shown in FIGS. 3 and 4, the stage 100 has a folding assist device 165 which aids in the initial folding of the stage from the unfolded position and the final folding of the stage to the folded position. Folding assist device 165 also acts to cushion the frame 100 and panels 104, 106 so that they do not inadvertently fully close, thereby pinching workers' hands or fingers between frame members. A spring 166 supports a floating stanchion 170 which rides in a stationary member of the frame 102. A floating tube portion is guided by a slot 168 in the stationary portion of the frame 102. The floating stanchion 170 supports a member of the folding framework 111. As shown in FIG. 3, when the stage 100 is in the use position, the floating stanchion 170 is fully depressed. The spring 166 exerts a constant pressure on the stanchion 170 against the folding frame member 111 even when the stage is in the fully-unfolded position. Therefore when the initial force is applied to fold the stage 100, the spring 166 pushes the folding frame member 111 toward the folded position. This aids in the initial folding as well as cushioning final folding.

When folding from the fully-folded position to the fully-unfolded position, the folding linkage will unfold until engaging the floating stanchion 170 supported by the spring 166, as shown in FIG. 4. The spring 166 and tube 170 prevent the stage from fully unfolding so that slight pressure, in addition to the weight of the stage, must be applied to fully unfold the stage and depress the floating stanchion 170, as shown in FIG. 3. This provides an added safety feature and eases the labor associated with folding and unfolding the stage 100.

Figure 5:
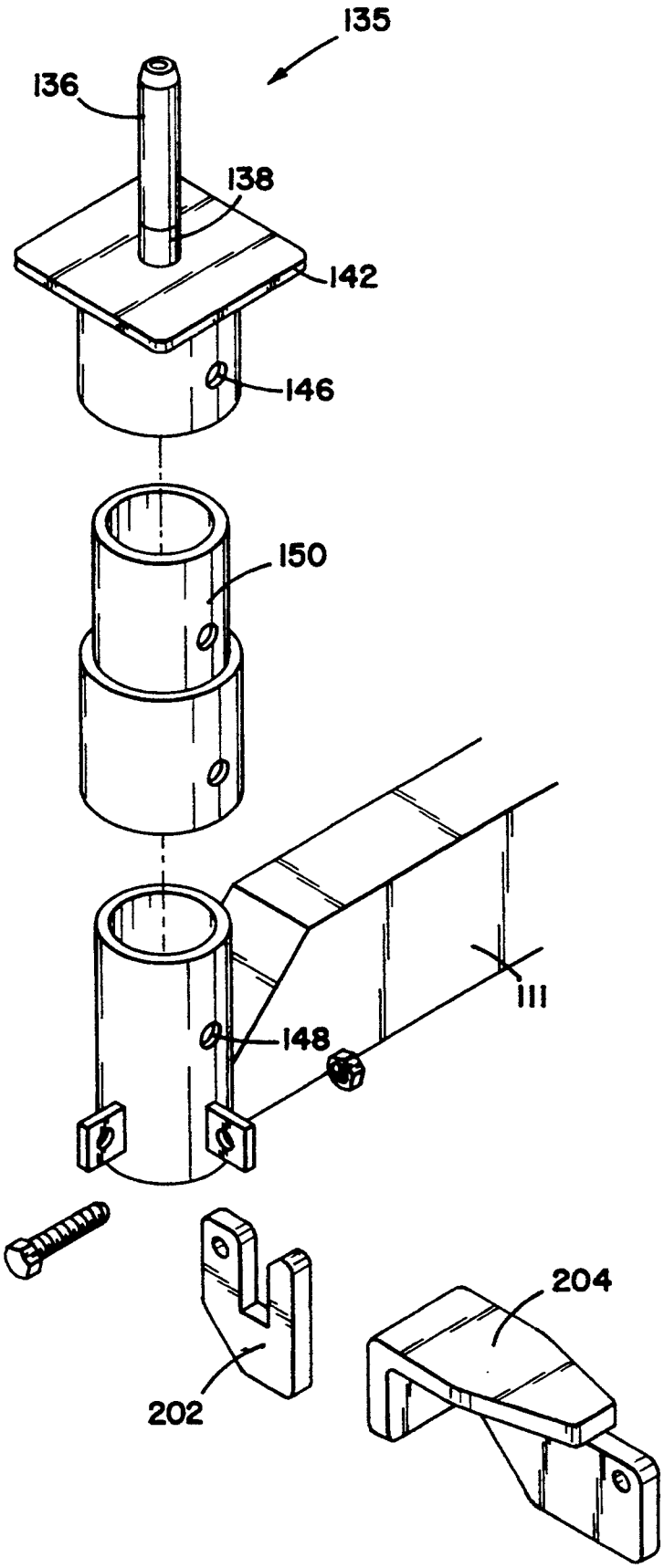
FIG. 5 shows an exploded view of the connector system for attaching the panels to the stage framework and for elevating one panel.
Figure 6:
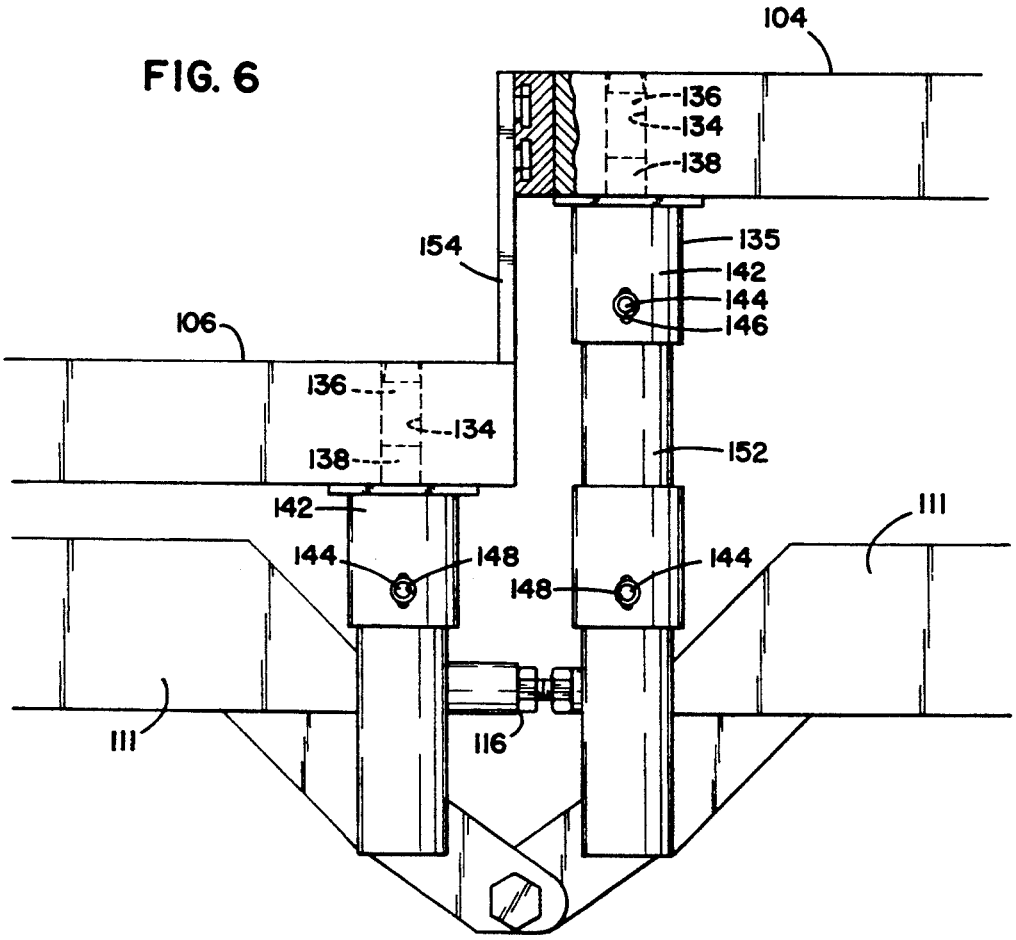
FIG. 6 shows a side view of the stage panels with one panel raised relative to the other panel and with a kickboard in place.

As shown in FIG. 5, the attachments between the frame 102 and the panels 104 and 106 are made with connectors 135 inserting into passages 134 of the panels 104 and 106. The passages 134 are located near each corner of the panels 104 and 106 and extend entirely through the panels 104 and 106. Each connector 135 mounts on support 142 which connects with a cotter pin 144 inserting through holes 146 in each support 142 to holes 148 in the frame 102. To raise one panel 104 relative to the other panel 106, risers 150 and 152 may be placed below the panel. The riser 150 or 152 extends the height of the stage panel without raising both panels 104 and 106. Typically the risers are either four inches or eight inches. When an eight inch riser 152 is inserted, a kickboard 154 is placed between the elevated panel 104 and the lower panel 106 to cover the space, as shown in FIG. 6. It can be appreciated that by raising one panel 104 relative to the other panel 106 on the stage, choral riser configurations may be achieved. It can also be appreciated that bridging panels extending between the stages may be raised with the elevated panels 104 to create extended choral risers.

Figure 20:
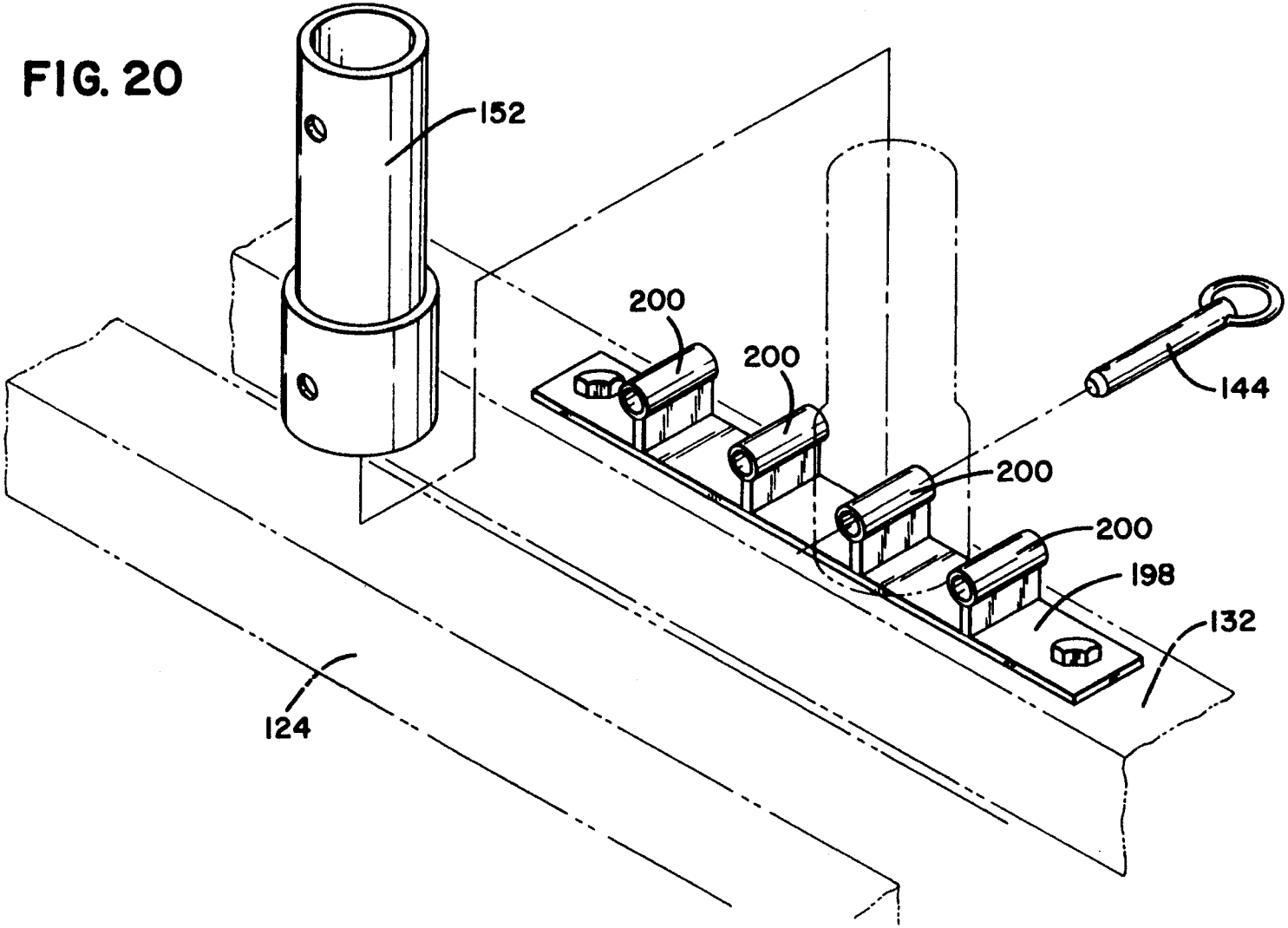
FIG. 20 shows a storage rack on the frame of the stage for storing height extending risers.

As shown in FIG. 20, risers 150 and 152 may be stored on the stage frame 102 when not in use. The risers 150 and 152 mount on storage racks 198 having riser storage members 200 thereon. The risers 150 and 152 slide over the storage members 200. The cotter pins 144 are then slid through the risers and the storage members 200, thereby retaining the risers in an out-of-the-way location.

As shown in FIG. 5, latching members 202 engage complementary latching member 204 for spacing and connecting bridge panels 108. The panels 108 are supported on the stage with connectors, as explained hereinafter.

Figure 7:
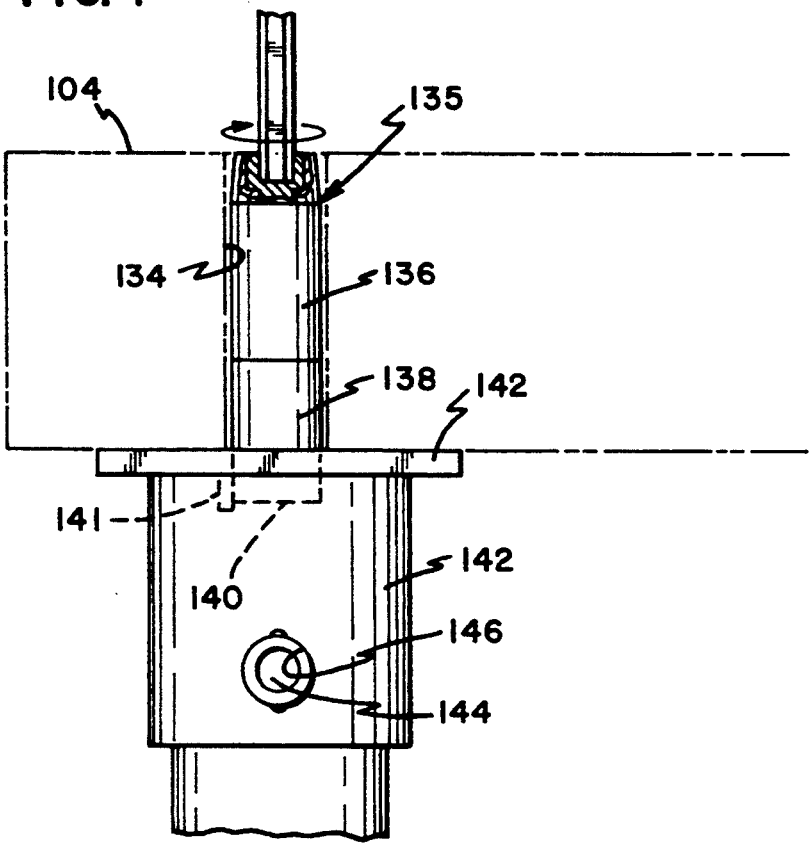
FIG. 7 shows a side sectional view through a stage panel with the connector extending into the panel in the unlocked position.
Figure 8:
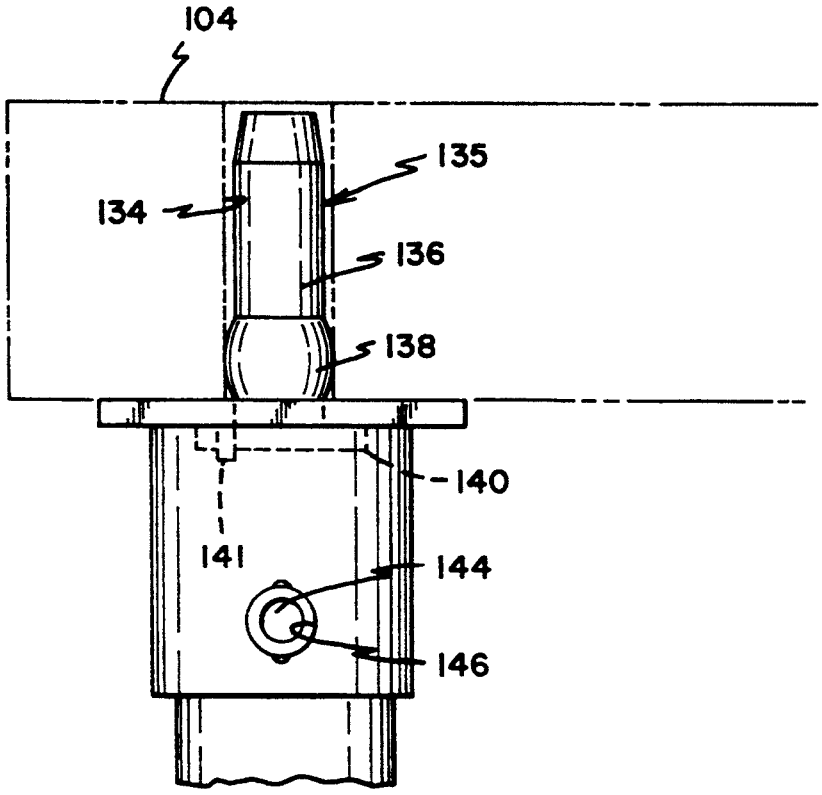
FIG. 8 shows a side sectional view of the connector shown in FIG. 7 with the connector turned into the locked position.

Referring now to FIGS. 7 and 8, the connector 135 extends through the passage 134 of the panels 104 and 106 to be substantially flush with the upper surface of each panel, as shown in FIG. 7. The connector uses a pin 136 extending upward from the support 142 to extend into the passage 134 of the panels. A portion of the pin 136 widens over a flexible compressible portion 138. When the pin 136 is turned and tightened, the compressible portion 138 expands radially as shown in FIG. 8 to engage the walls of the passage 134. This causes frictional engagement between the connector 135 and the passage 134, thereby retaining the panel against the frame 102. The pin 136 is mounted with a flexible base 140 which allows slight movement of the pin 136 for alignment into the passages 134. The flexible base 140 is adjacent a stop plate 141. The base 140 has a length greater than its width so that when the pin 136 is rotated, the base 140 engages the stop plate 141, as shown in FIG. 8, to prevent additional rotation of the pin 136. It can be appreciated that with a standard set screw head on the bolt, standard hex wrenches may be used to tighten the stage panels 104 and 106 to the frame 102. In addition, since the connector 135 is a single piece attached to the frame 102, no extra loose pieces are needed, so that pieces will not be lost when attaching panels to the frame. It can also be appreciated that the connectors 135 provide a substantially flush surface with the panels 104 and 106.

Figure 9:
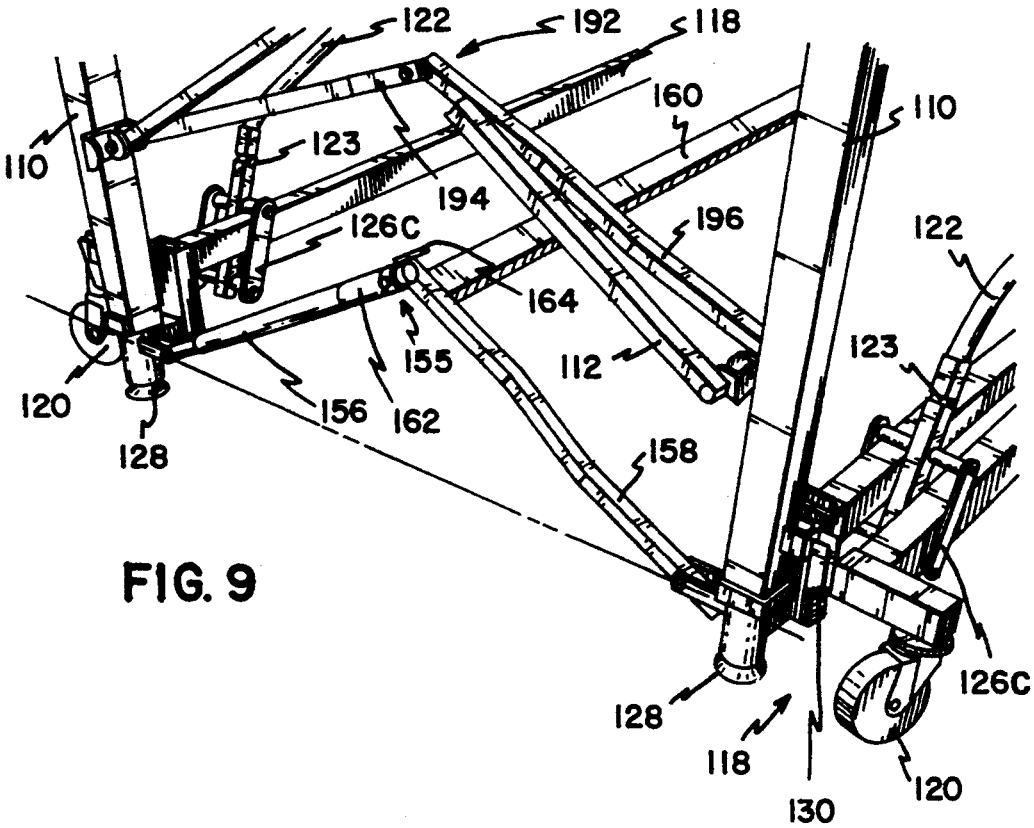
FIG. 9 shows a perspective view of the locking mechanism for the stage shown in FIG. 1 in the partially folded position.
Figure 10:
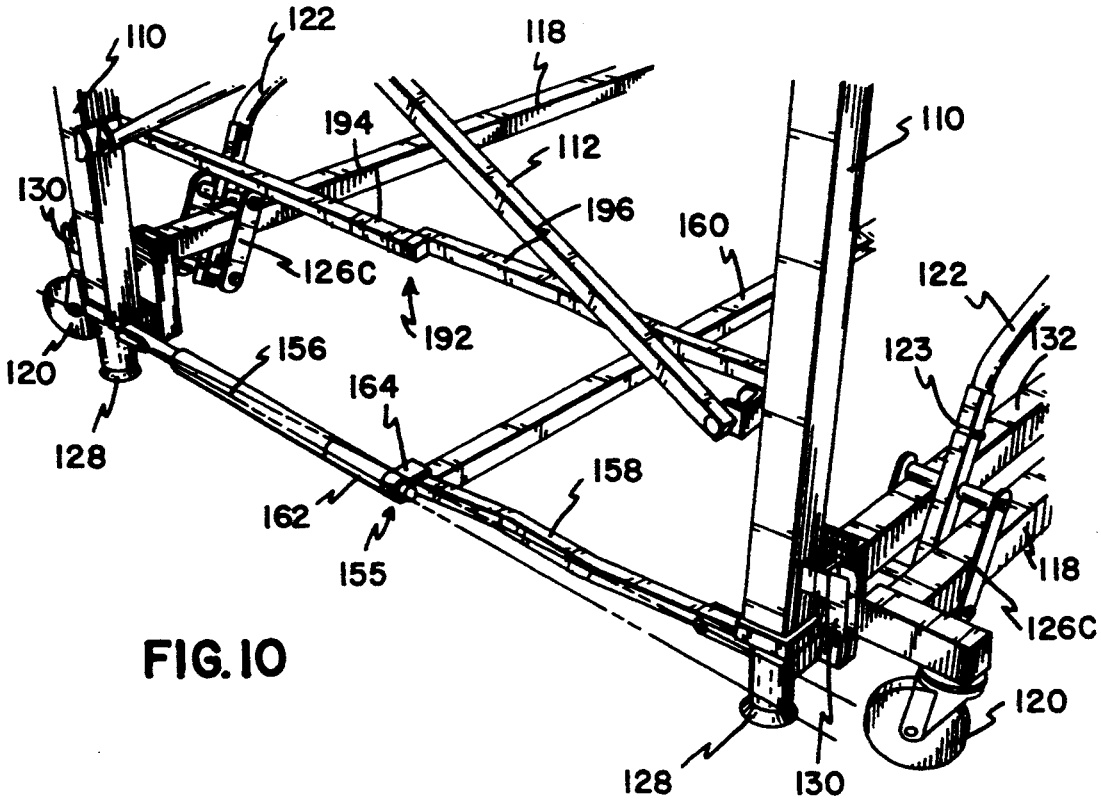
FIG. 10 shows a perspective view of the locking mechanism shown in FIG. 9 with the stage unfolded and the locking mechanism locked.

As shown in FIG. 9, to lock the stage in the fully unfolded position, a locking linkage 155 is provided which locks folding halves of the frame. The locking linkage 155 has a pair of cross links 156 and 158 extending between legs 110 from underneath each panel 104 and 106. Cross link 156 has a handle 162 which provides for lifting and lowering the linkage and a stop 164 for holding the linkage 155 in a locked position. The linkages 155 between the opposing pairs of legs are connected by a member 160 extending along the center of the stage. To lock the stage 100 in the use position, the locking linkage in the position shown in FIG. 10 is pushed downward through the toggle point, shown in phantom. When the linkage 155 is passed through the toggle point, the cross link 158 engages the stop 164, preventing further folding of the linkage. Any inward pressure against the linkage 155 forces the link 158 against the stop 164 so that the stage 100 is prevented from folding.

In addition, a spacing linkage 192 between one pair of legs 110 and above one of the locking linkages 155 is provided to space the legs during height adjustment of the stage 100. The spacing linkage 192 has links 194 and 196 extending between the legs and above the locking linkage 155. The spacing linkage 192 folds with the stage, but acts with the locking linkage 155 to prevent the stage 100 from folding during elevational adjustment.

As shown in FIG. 2, bridging panels 108 may be stored on top of the panels 104 and 106 when the stage 100 is folded. The panels 108 extend the area of the stage surface between stages 100. This provides for an extended continuous stage surface without having a frame below each stage panel. Storage of the bridge panels 108 on folded stages saves on storage space and eliminates additional caddies for transporting the bridging panels 108. By having the panels 108 stored on the stage, they are always within easy reach of their final use position.

Figure 11:
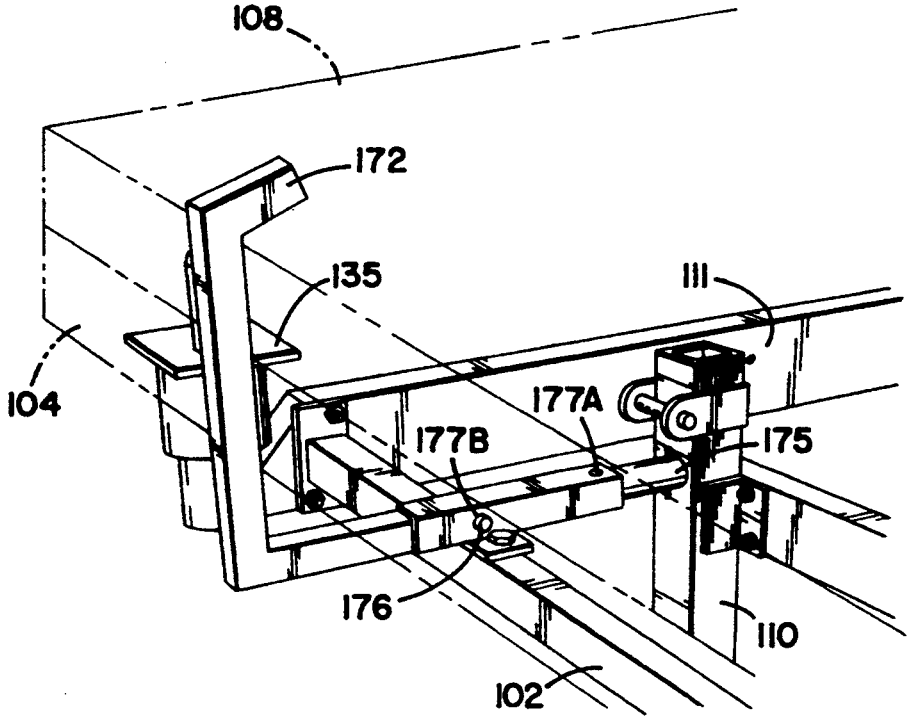
FIG. 11 shows a perspective view of a lower retaining member in the retaining position for retaining stored panels on the stage.

The bridge panels 108 are retained on the stage 100 by hook members 172 along the lower edge of the panels and hook members 174 near the upper portion of the panels. As shown in FIG. 11, the lower hook members 172 extend beyond the edge of panel 104 or 106 and the bridging panel 108. The hook extends above the upper surface of the base of the stage panels and supports the lower edges of the stage panels as well.

Figure 12:
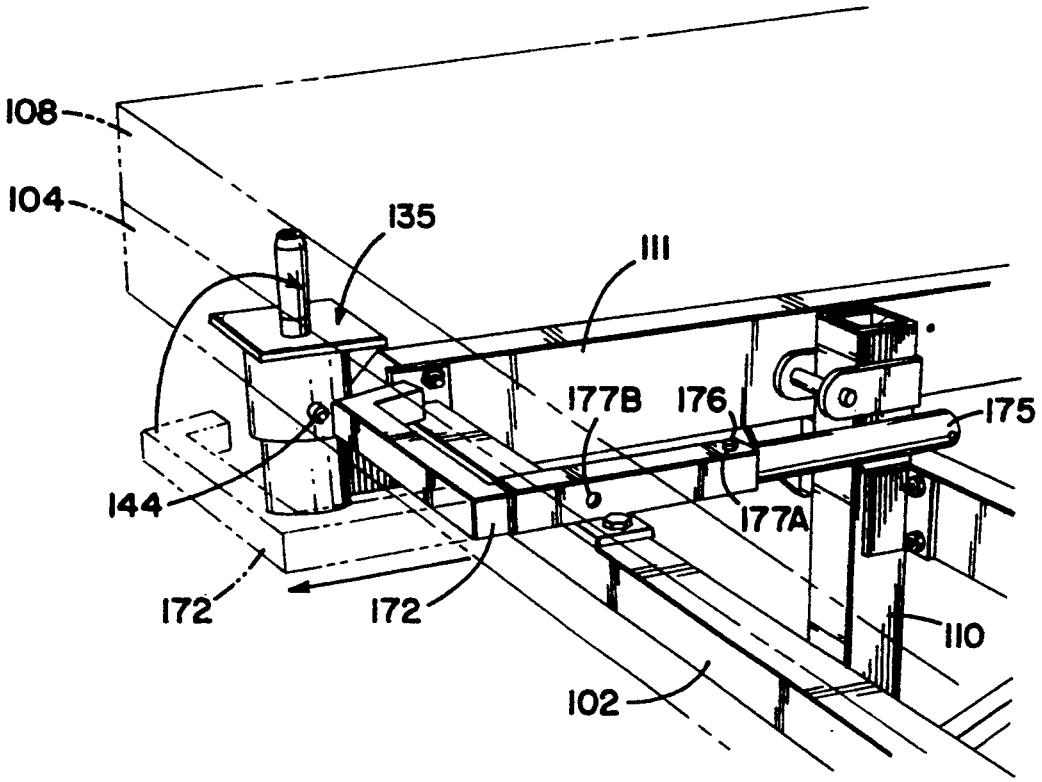
FIG. 12 shows the retaining member shown in FIG. 11 with the retaining member in the non-retaining retracted position.

As shown in FIG. 12, the lower hook members rotate about a shaft portion 175 to the side and then slide under the panels 104 and 106 when the retaining hook members are not being used. The hook members 172 are kept in either the storage or in position by engaging or disengaging a spring-loaded release button 176. The release button 176 extends through holes **177*a* and 177*b* in a mounting member to retain the hook members in hidden or use positions. The hole 177*a* is slightly smaller than the button 176 so that it is slightly depressed even when aligned with the hole 177*a*, thereby providing some resistance to rotating, but not locking the members 172 in the hidden position. The release button 176 does fit into hole 177*b* so that it must be manually depressed to rotate the hook members 172** from the panel-retaining position.

Figure 13:
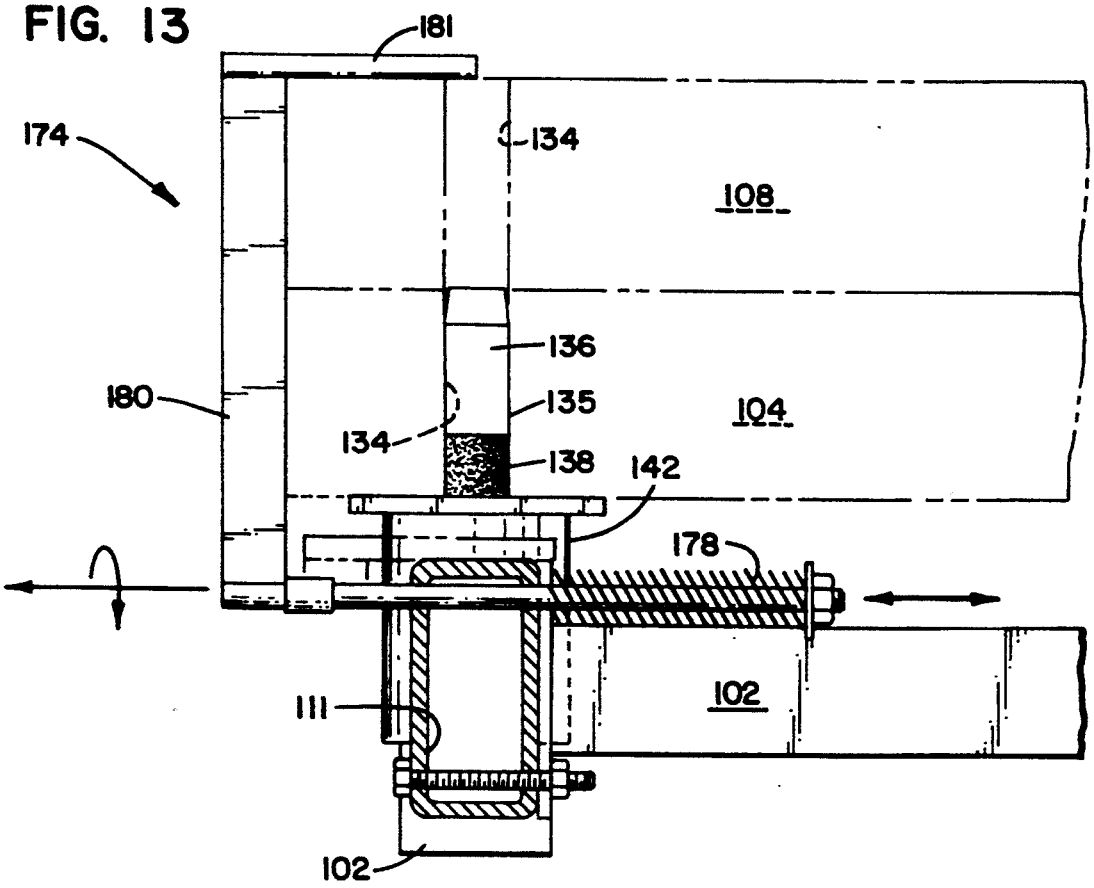
FIG. 13 shows a side view of an upper retaining member for retaining the panels stored on the stage and a portion of the panel with the retaining member in the retaining position.

As shown in FIG. 13, the upper members 174 mount on the folding frame 111 and are spring-loaded so that each member 174 is held tightly against the folding frame 111. A spring 178 forces the hook member 174 toward the frame 102, shown in FIG. 2, so that an upper portion 181 of the hook members 174 rests between the panels 104, 106 and the folding frame 111 during storage. When in use, a handle portion 180 is grasped and the members are pulled away from the frame and lifted outward and upward. The upper portion 181 of the hook member 174 then is placed above the bridge panel 108 and the spring 178 pulls the upper portion 181 of the hook member over the panel 108.

The hook members 172 and 174 provide for storing the bridging panels 108 without requiring additional tools or loose extra pieces which are not connected to the stage 100.

Figure 14:
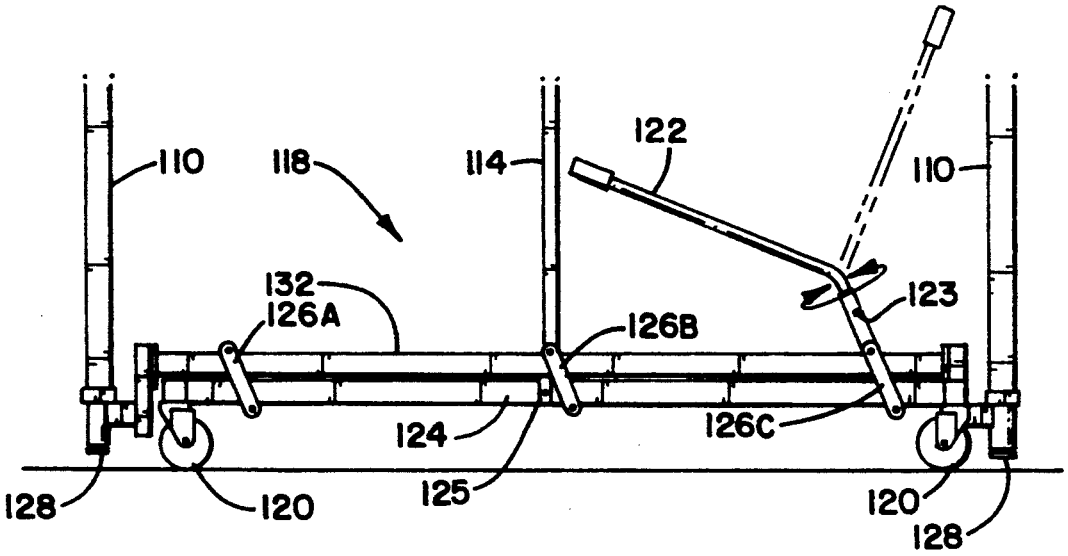
FIG. 14 shows a side view of the roller assembly for the folding stage shown in FIG. 1 with the rollers fully lowered and engaging the ground.
Figure 15:
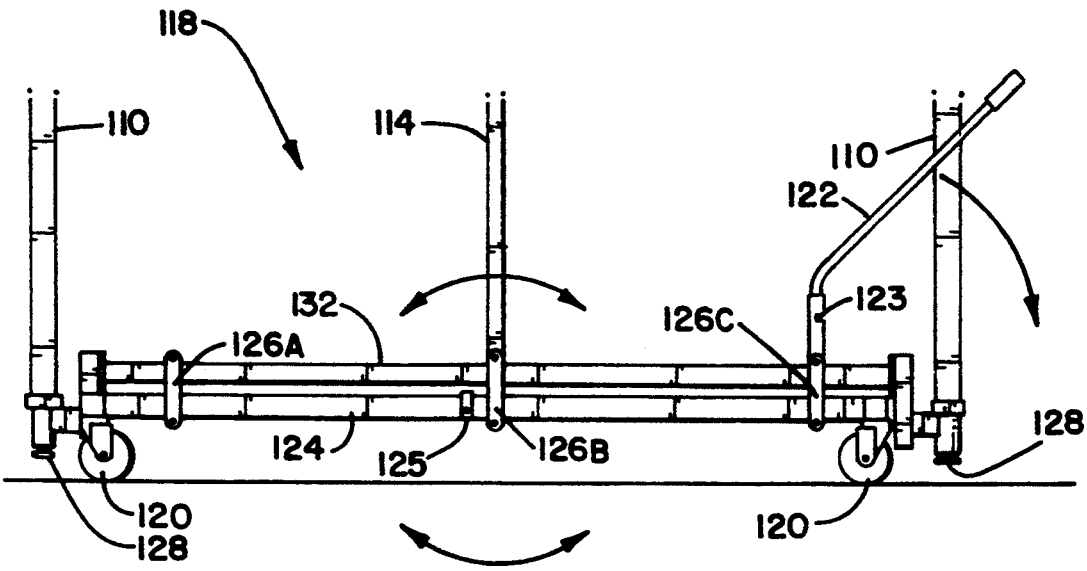
FIG. 15 shows a side view of the roller assembly shown in FIG. 14 partially retracted with the rollers engaging the ground.
Figure 16:
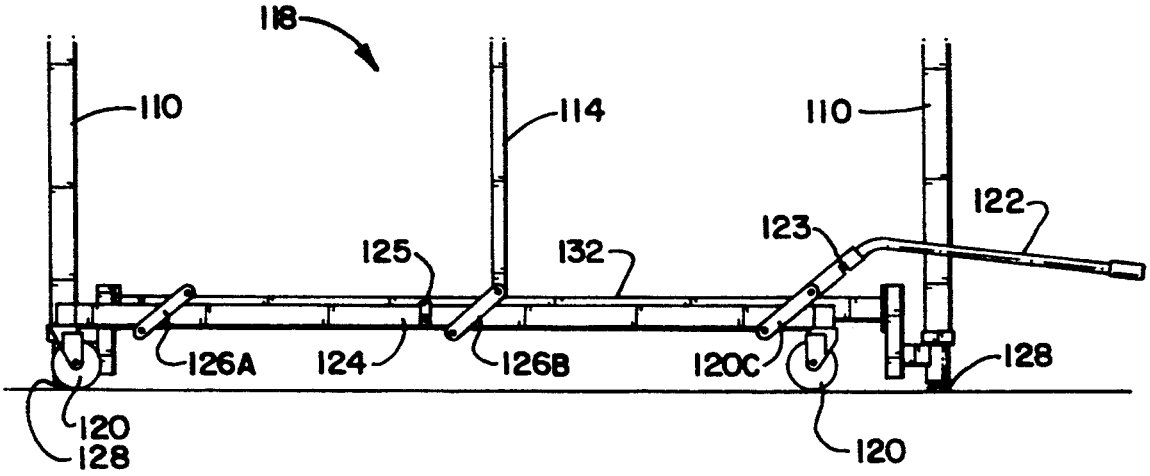
FIG. 16 shows the roller assembly shown in FIG. 14 with the rollers fully raised and the legs engaging the ground.

As shown in FIGS. 14–16, the stage 100 has roller assemblies 118 which can be used to roll the stage between use and storage locations. The roller assembly 118 raises and lowers the stage so that the legs 110 engage or disengage the ground. As shown in FIG. 14, when the roller assembly 118 is fully lowered, rollers 120 engage the floor and the legs 110 are fully raised from the floor so that the stage 100 rolls to various locations. When the roller assembly 118 is lowered, the stage 100 may be rolled in either the folded or unfolded position. When the roller assembly 118 is raised as shown in FIG. 16, the legs 110 engage the ground and the rollers 120 do not support any weight of the stage so that the stage cannot move from the use position.

In order to raise and lower the roller assembly 118, a handle 122 attaches thereto. The handle 122 can be rotated between a storage position for storage and a use position to provide maximum mechanical advantage. The rotation of the handle 122 is limited by a slot 123 on a handle receiving portion of mounting beam 124. The mounting beam 124 has rollers 120 mounted thereon and rises and falls along with the rollers 120. The mounting beam connects to a beam 132 of the frame by links **126*a, b & c*. Upon actuating the handle 122, the roller assembly 118 is pivoted from the raised position as shown in FIG. 16 through the position shown in FIG. 15 wherein both the rollers 120 and legs 110 engage the ground to the fully-lowered position as shown in FIG. 14, wherein the rollers 120 engage the ground and lift the legs 110 off the ground. The links 126 pivot the beam 124 up and down relative to the frame 102 and maintain the rollers 120 parallel to the ground. Center link 126*b* engages a stop 125 on the beam 132 of the frame to prevent further pivoting of the links 126 and maintain the rollers 120 in a fully-lowered position. In addition, the handle 122 is elevated and near the panels 104 and 106 and provides for raising and lowering the stage 100** without reaching down to near the floor level as had been required with prior roller assemblies for stages.

Figure 17:
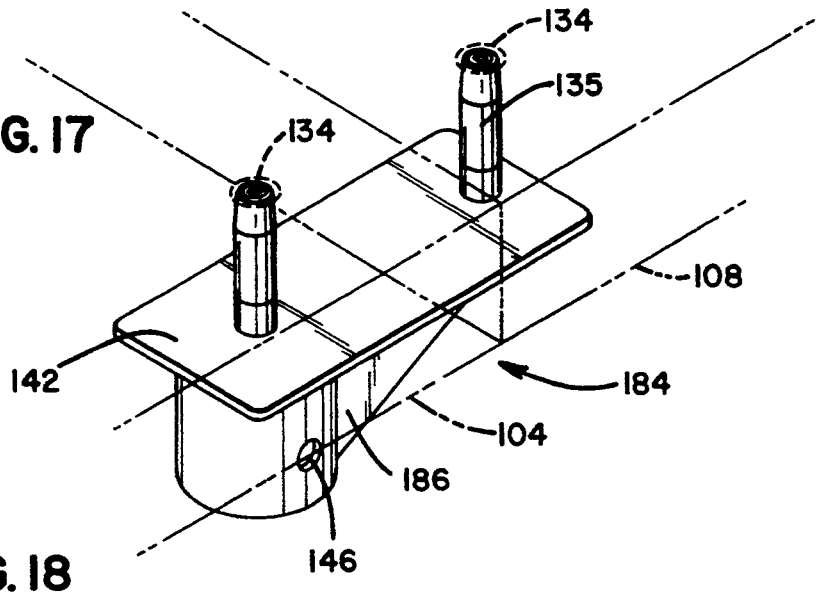
FIG. 17 shows a perspective view of a bridging device for supporting an adjacent panel.

As shown in FIG. 17, to support the bridging panels 108 between stages, a bridging support member 184 is implemented. The support 184 includes a connector 185 placed on the frame of folding or other stage in the same position as a single support 142. The two-way support 184 includes a gusset 186 for additional strength which supports the second connector 135 which inserts into a bridging panel 108.

Figure 18:
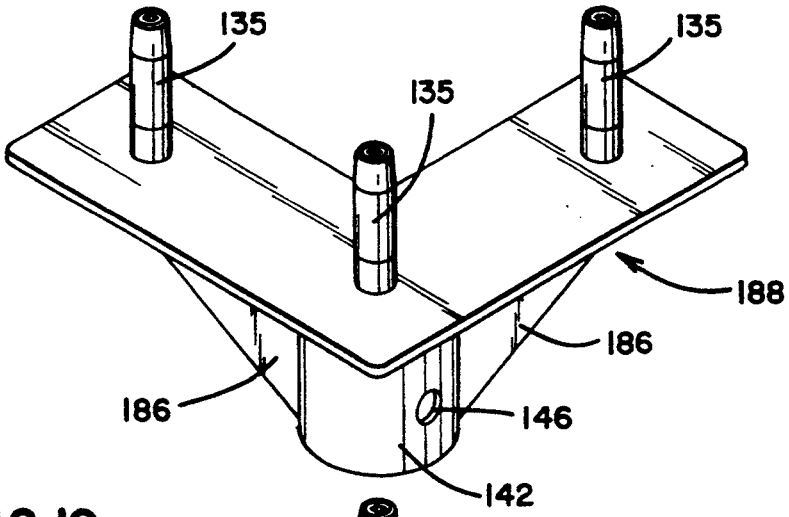
FIG. 18 shows a perspective view of a bridging device supporting an adjacent panel on two sides of the stage.

In addition to supporting a single bridging panel 108 off one side of a stage, panels 108 may be supported off two sides of the stages with a three-way support 188, shown in FIG. 18. As with the two-way support, the three-way support attaches to the stage frame in the same position as the single support 142. The three-way support includes a connector for the stage as well as connectors 135 for each of the bridging panels.

Figure 19:
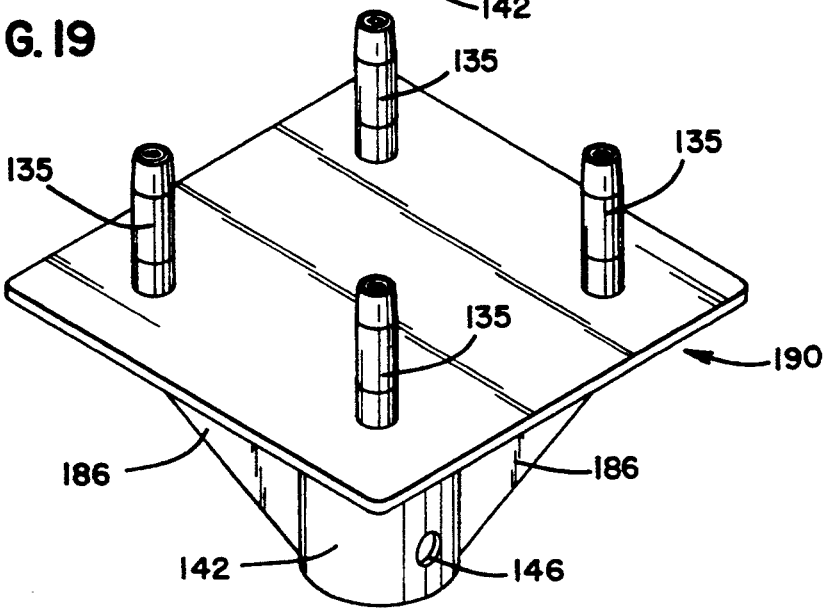
FIG. 19 shows a four-way bridging device for supporting three panels adjacent the stage at a corner.

As shown in FIG. 19, bridging panels 108 may be supported from stages off both sides and also between the bridging panels extending off both sides for an even larger extended stage surface. In order to support the three additional bridging panels 108, a four-way support member 190 is implemented which attaches in the same manner as the single, double and triple supports.

Figure 21:
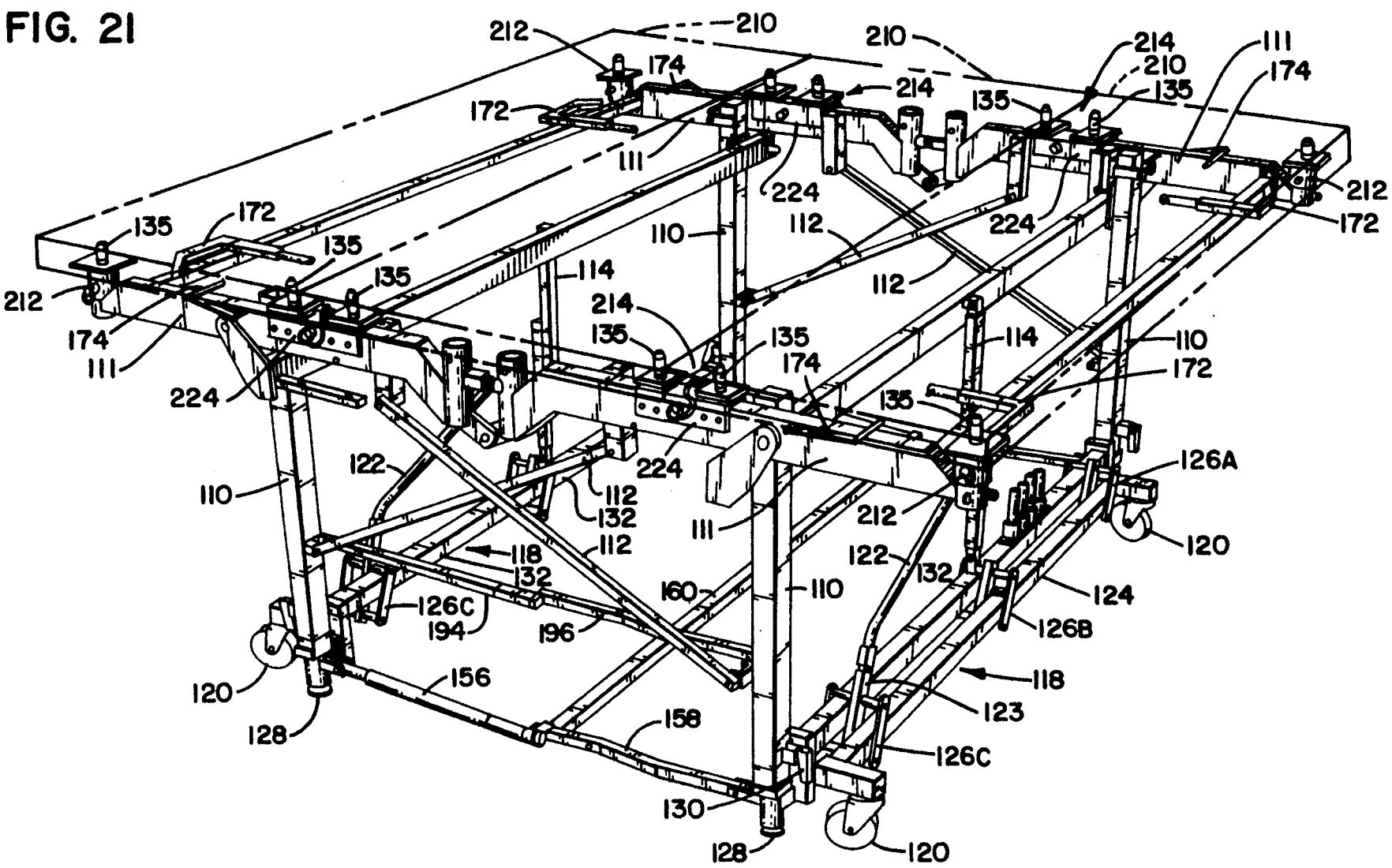
FIG. 21 shows a perspective view of a folding stage supporting three panels in the use position.

As shown in FIGS. 20 and 21, the stage 100 may also be configured to support three stage panels 210*a, b & c*. In the preferred embodiment, the panels 210 are similar to the panels 104 and 106, but have a narrower width so as to form a stage surface substantially the same size as the stage 100 when configured to support two panels.

The panels 210 are supported by support members 212 and 214. At the four corners of the stage 100, single supports 212 are used which engage the panels 210 with connectors 135 in a manner similar to that for engaging the wider panels 104 and 106. As the center panel 210*b* spans the folding line of the stage framework 102, double support members 214 are utilized which have a pair of the pin-type connectors 135 which are mounted on the double support bracket 214 and spaced a distance so as to engage the passages 134 at each of the panels 210.

Figure 22:
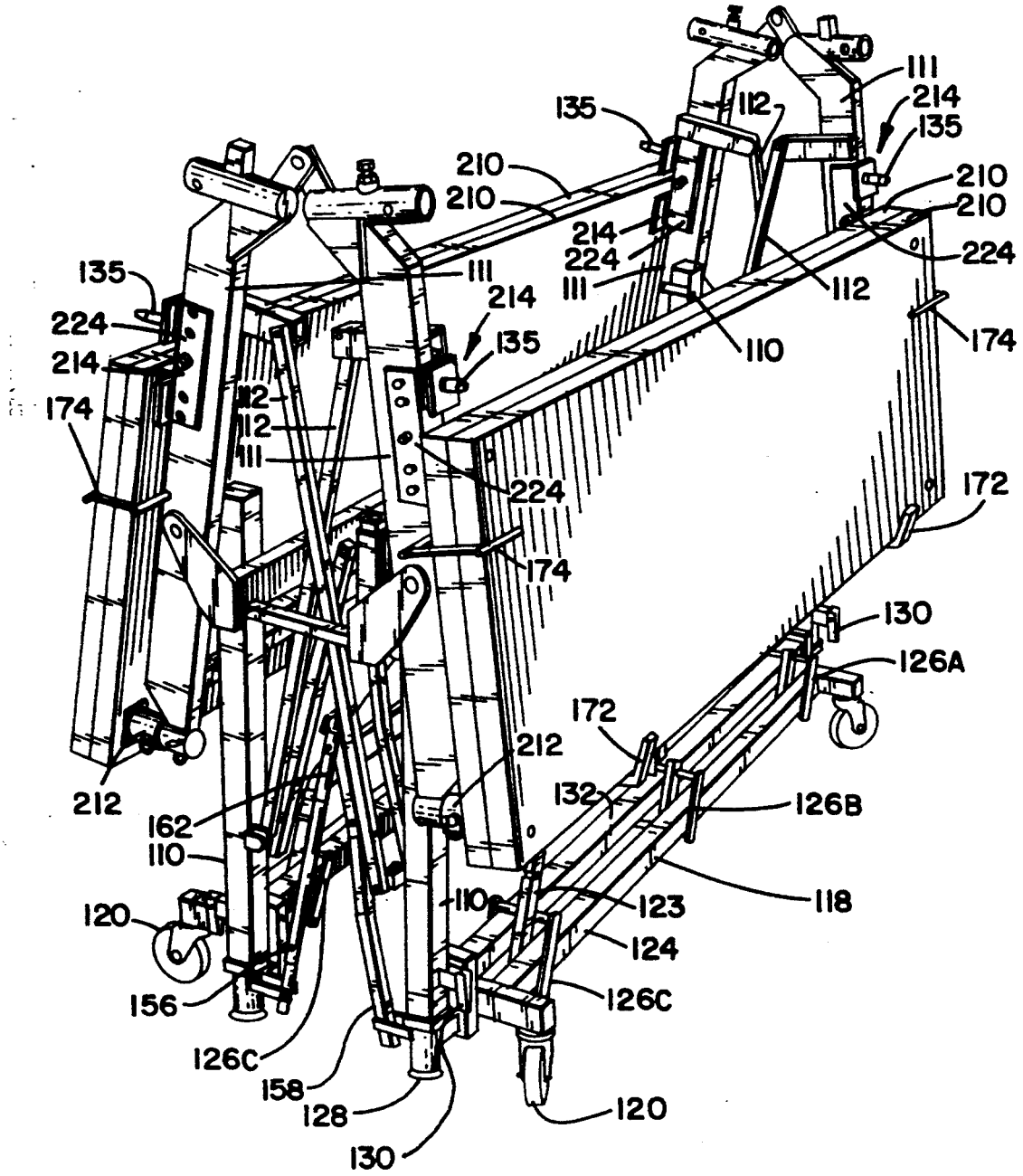
FIG. 22 shows a perspective view of the stage shown in FIG. 21 having three panels, the stage being folded in a storage position.

As shown in FIG. 22, the stage 100 supports the panels 210 in a folded position as well as in a use position. However, the center panel 210*b* is removed so that the stage may fold. The center panel 210*b* along with an additional panel 210*d* such as may be used for bridging can then be stored in a manner similar to that when the stage is configured for two panels 104 and 106. Since three additional bridging panels will be required between stages 100, it can be appreciated that there may be additional panels 210 which may need to be stored such as on a cart or other device. However, since a portion of the bridging panels 210*d* may be stored on the unfolded stage 100, it can be appreciated that the number of trolleys or carts is reduced. It can also be appreciated that since the three panel configuration has narrower panels 210, the side hook members 174 must be repositioned to a location near the lower edge of the panels 210 when folded, so that the panels 210 are still engaged by the hook member 174. The lower hook members 172 remain at the same position as for a two panel stage and are able to retain both the panels 210 on the stage and the bridging panels 210*d* as well.

Figure 23:
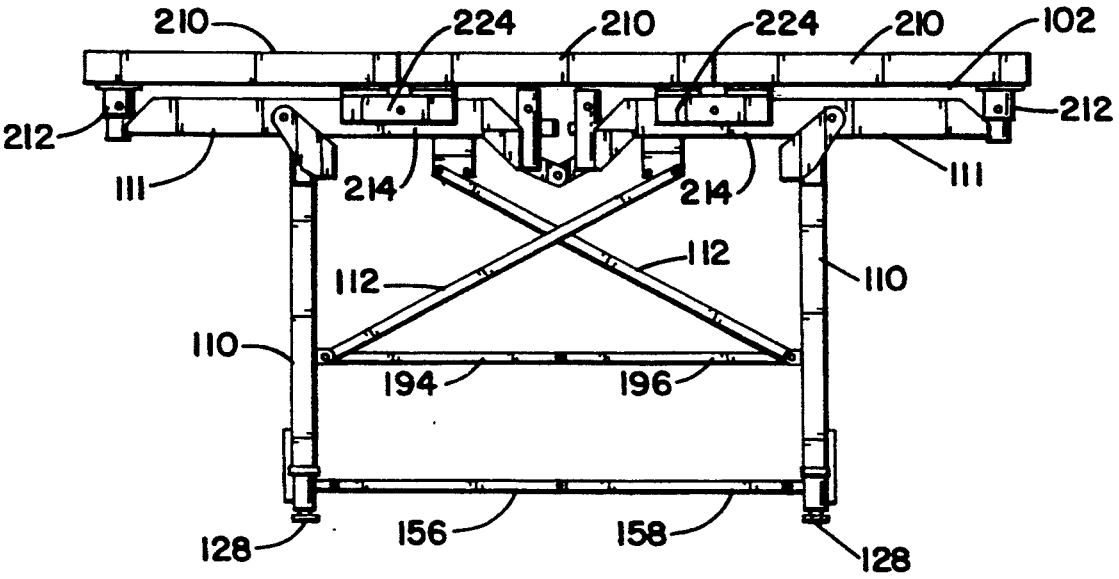
FIG. 23 shows an end view of a stage having three surface panels forming an extended flat stage surface.

As shown in FIG. 23, the panels 210 mount on the frame 102 so that the panels are adjacent to one another and so that the center panel 210*b* spans the center folding line of the stage 100. When the stage is configured as shown, an extended stage surface is formed.

Figure 24:
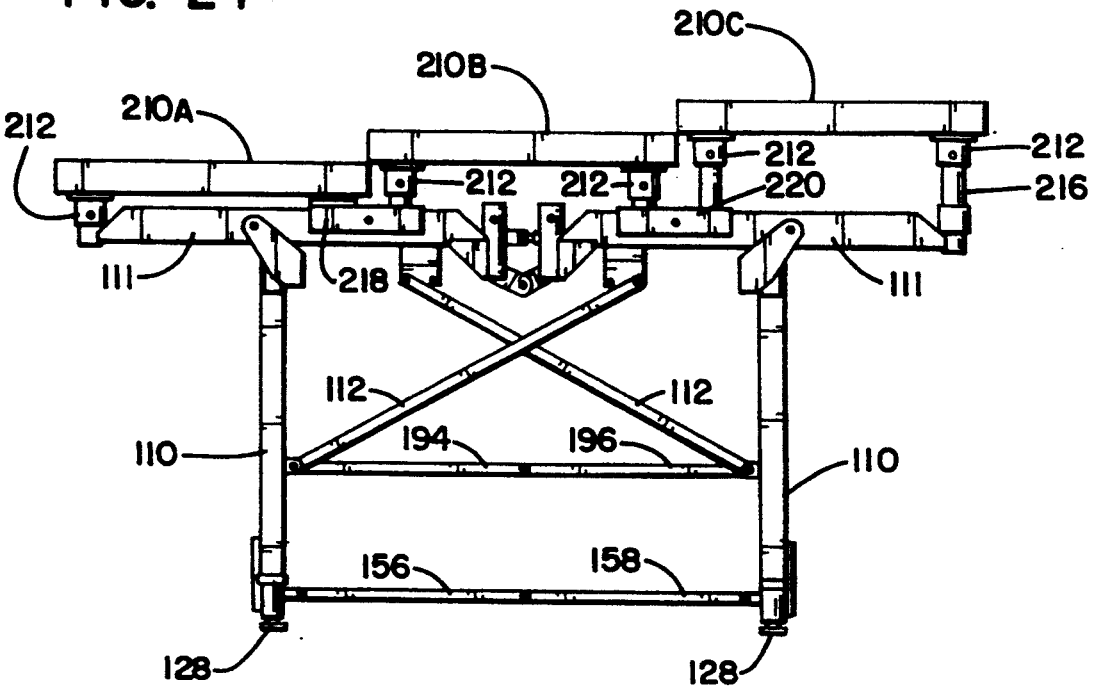
FIG. 24 shows an end view of a stage having three surface panels in a choral riser arrangement.
Figure 26:
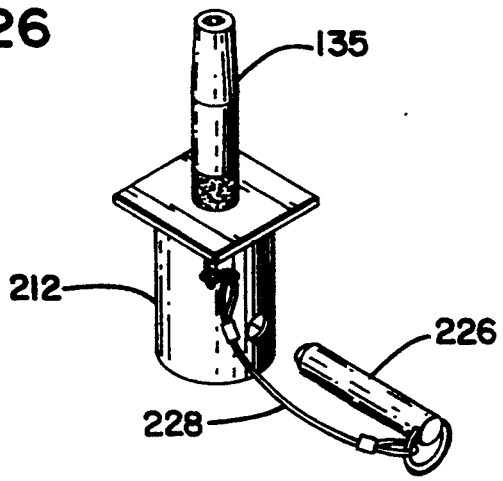
FIG. 26 shows a perspective view of a support pin and bracket for a lower corner of the stage.

As shown in FIG. 24, the stage may also be set up in a choral riser type configuration. The panels 210*a,b,c* are at different escalating heights and may be used for seating in a rising bleacher type arrangement. As explained hereinafter, various supports are substituted for the supports 212 and 214 to achieve a choral riser type configuration. To transform the stage 100 from a flat extended stage surface to a choral riser type configuration, the lowermost corner supports 212, shown in FIG. 26, remain. The support members 212 include a retaining pin 226 on a retaining line 228. The retaining pin 226 inserts through orifices in the lower portion of the support member 212 and into the frame 102. The pin 226 is retained by a spring loaded ball members extending outward or cotter pins or other retaining devices.

Figure 27:
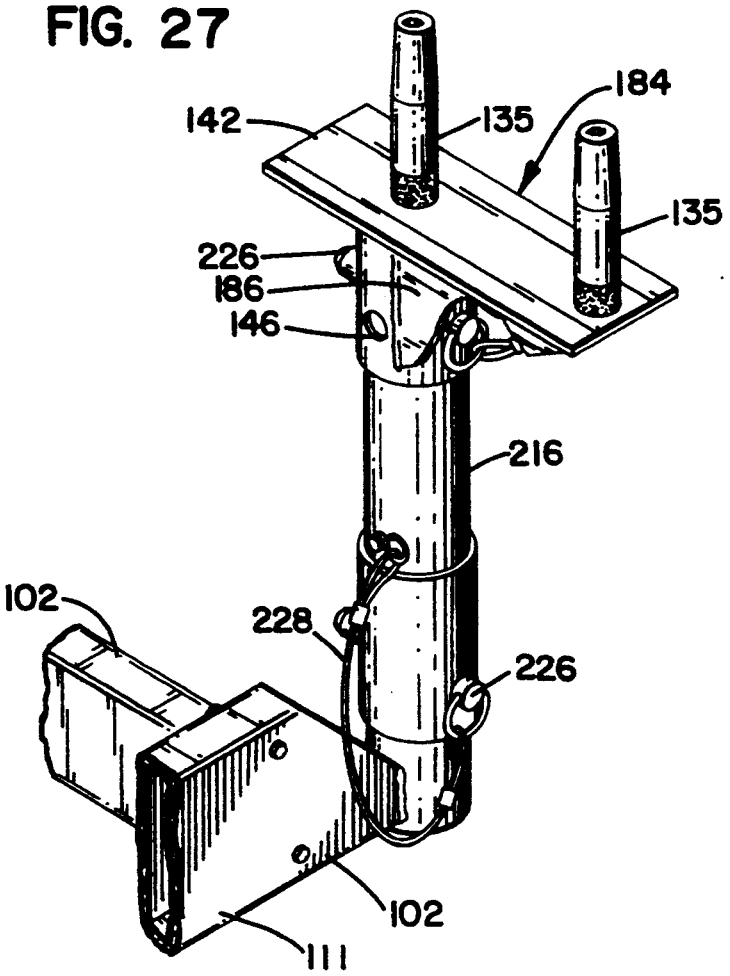
FIG. 27 shows a perspective view of a support riser and support pins for a raised support of choral risers including a pin connector for bridging.
Figure 28:
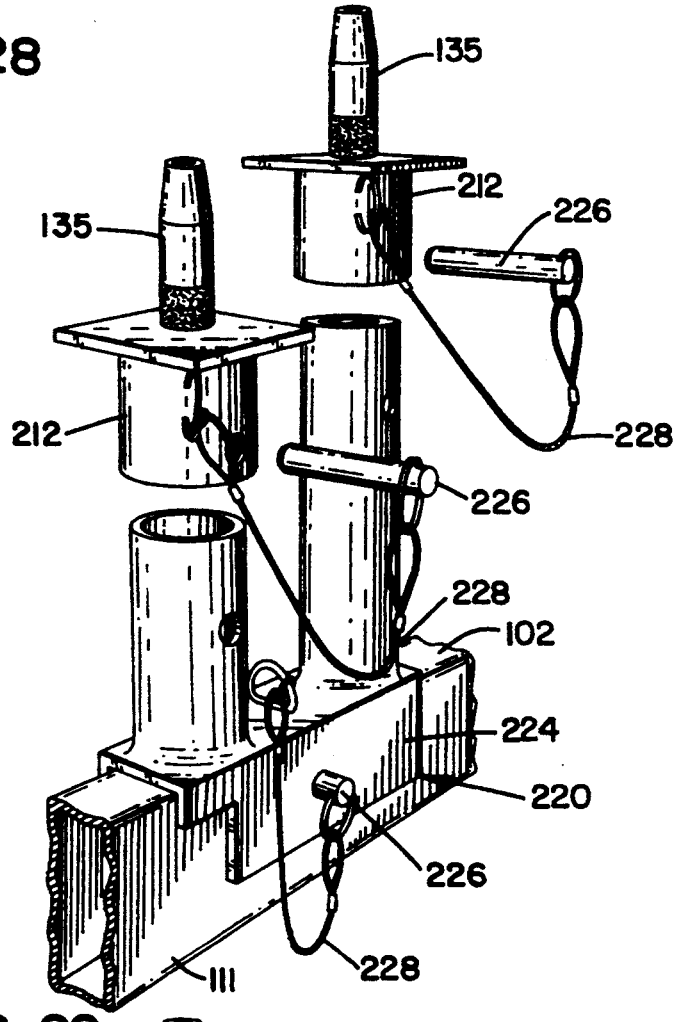
FIG. 28 shows a perspective view of a double support member for a choral riser arrangement supporting two pin-type connectors.

The single support members 212 on the high side of the choral riser must be raised on a riser 216 to elevate the single bracket 212 and support a raised panel 210*c*. As explained hereinafter and shown in FIG. 27, the riser may also support a double bridging support member 184 so that elevated bridging panels 210*d* may be supported between stages.

In addition, the double support members 214 must be replaced by double support riser members 218 and 220. In standard riser configurations, the panels 210 will be elevated four inches higher than the next lower panel 210, therefore the lowermost panel 210*a* may remain flat while the center panel 210*b* is raised four inches. Therefore one of the double support members 214 is replaced by lower double support member 218 which has a pin-type connector 135 which is raised four inches above the second lower pin-type connector 135. In a similar manner, the upper double support member 220 has the lower pin-type connector 135 raised four inches to support center panel 210*b* and the upper supporting pin-type connector 135 raised another four inches so that the uppermost panel 210*c* is four inches higher than center panel 210*b* and eight inches above the lowermost panel 210*a*.

Figure 25:
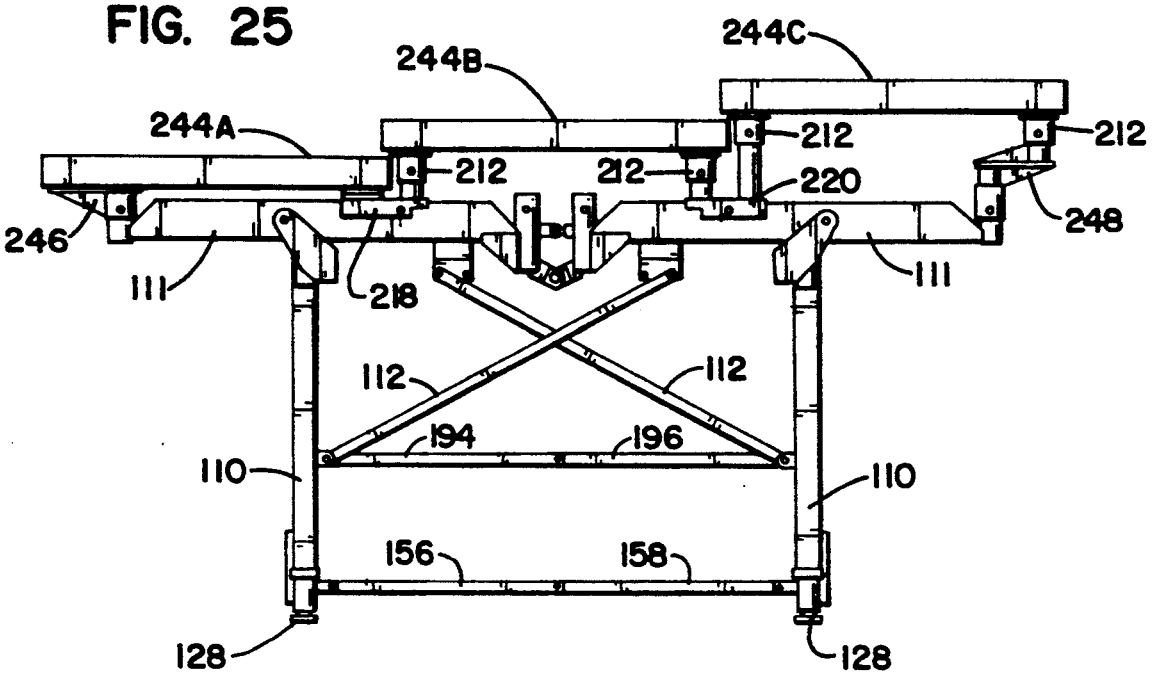
FIG. 25 shows an end view of a stage having three surface panels extending over edges of the stage in a choral riser arrangement.

In addition, as shown in FIG. 25, extended wider panels 244 may be utilized in a three panel stage which extend over the edge of the framework 102 and nest slightly as well. Utilizing the wider panels 244 requires an extender support 246 which extends over the edge of the framework 102 at the lowermost portion to support the lowermost panel 244*a*. In addition, a riser type extender support 248 is placed under the uppermost panel 244*c* and over the edge of the framework 102 to support the uppermost panel 244*c*.

It can be appreciated that whether in the extended stage configuration or in the choral riser type configuration, the present invention is adapted for supporting panels between adjacent stages to form an extended stage or a choral riser. To bridge between the stages 100, each of the single support type members 212 is replaced with a double support member 184. The support member 184 includes a first pin connector 135 supporting panel 210, and a second pin 135 extended outward which will support a bridging panel 210*d*. It can be appreciated that the support members 184 may replace any of the single support members 212 and easily mount to the stage 100 where support member 212 is mounted.

Figure 29:
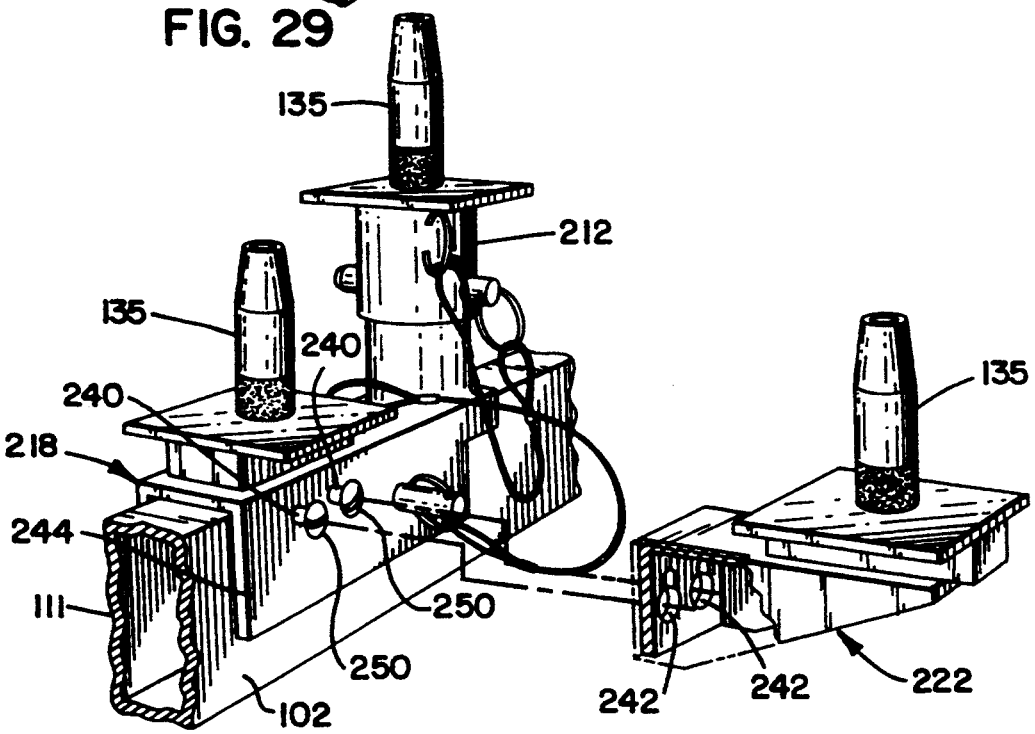
FIG. 29 shows a perspective view of a double support member supporting two pin-type connectors for a lower portion of the choral riser with a bridging support member shown in an unattached position.
Figure 30:
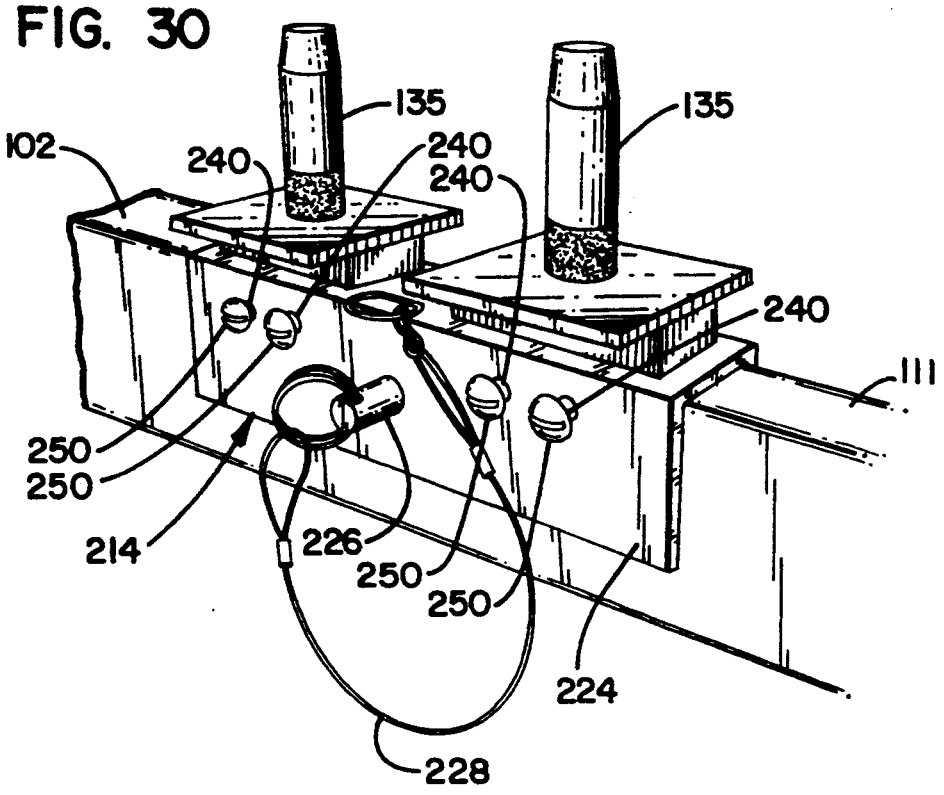
FIG. 30 shows a perspective view of a double support member supporting two pin-type connectors for a flattened extended stage arrangement.

In addition, the double brackets support members 214 include a pair of bridging support pins 240 extending from saddle portion 224. The support pins include retaining heads 252 which are larger than the body of the pins 240. The support pins 240 support a bridging member 222 which includes a pair of keyholes 242 along a vertical wall of the member. The holes 242 which are aligned with the support pins 240, include an enlarged lower portion reducing in size to a smaller upper portion, as shown in FIG. 29. Bridging member 222 is then retained by the pins as the support member 222 slides easily over the heads 252 of the support pins 240 so that the smaller upper portion of each orifice 242 is engaged by the pin body. This allows for easy attachment and detachment of the bridging member 222 and provides for secure support of the bridging member. The bridging member 222 supports a first pin-type connector 135 supporting panels 210*a* or 210*b* and a second pin-type connector 135 which supports a bridging panel 210*d*. The bridging members 222 are used in the flat stage configuration for the double supports 214 and for the lowermost support when used with the lower support member 218 in a choral riser type arrangement.

Figure 32:
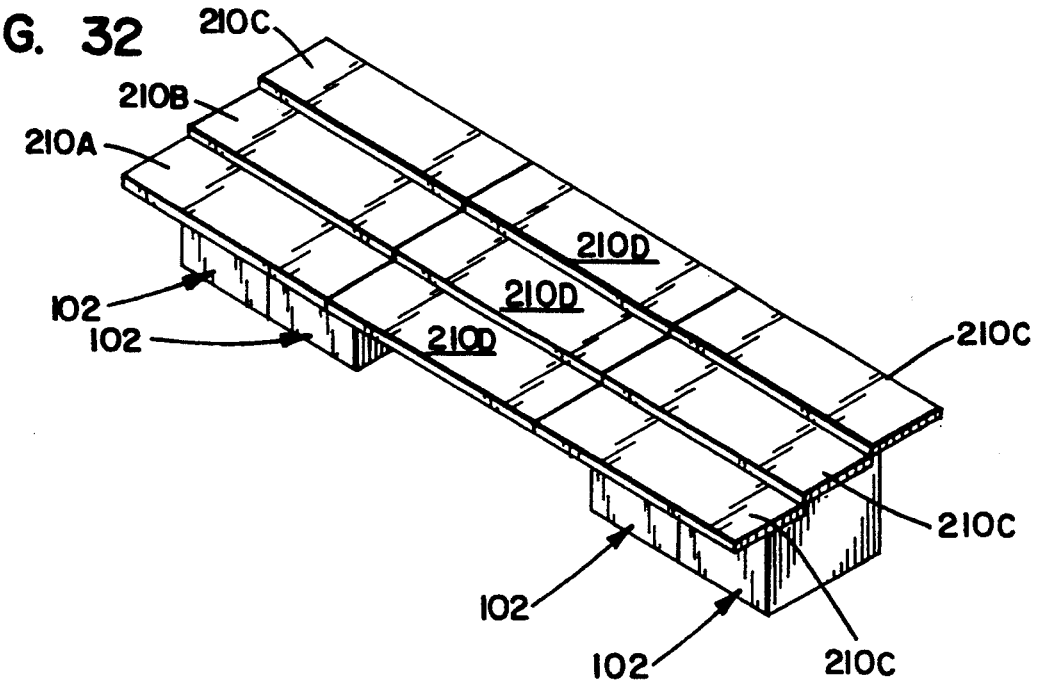
FIG. 32 shows a diagrammatic perspective view of two stages supporting bridge panels in a choral riser arrangement.
Figure 31:
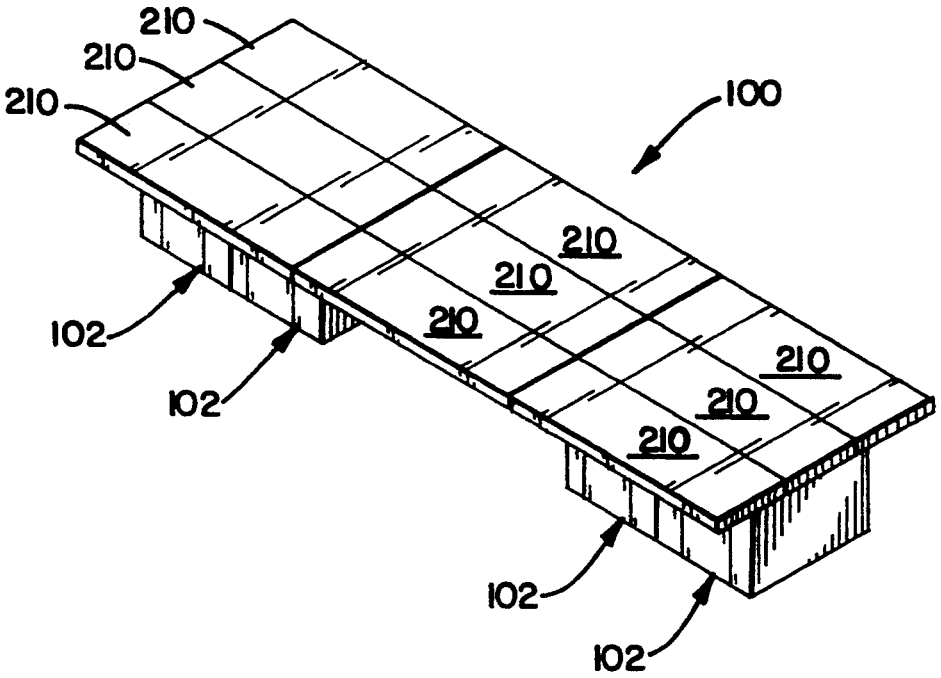
FIG. 31 shows a diagrammatic view of two stages supporting bridge panels in a three-panel-per-stage arrangement.

It can be appreciated that with the bridging members 222 and 184 supporting bridging panels 210, extended stage surfaces may be reformed, as shown in FIG. 31. In addition, it can be appreciated that bridging members 184 and 222 supporting bridging panels 210 can be used even when they are configured as a choral riser as shown in FIG. 32.

It can be appreciated that the present invention provides for configurations which may easily support either a two or three panel stage 100. To support two panels 104 and 106, the framework 102 receives single supports 212 at the corners and at the center folding line to support the panels 104 and 106. These are retained by a pin 226 which may be easily removed. It can also be appreciated that a two-panel stage may utilize double supports 184 to bridge between a two-panel stage.

By adding the support members 214, the stage 100 may be easily configured for supporting three panels, 210*a,b,c*. The support member 214 includes a saddle 224 which slides over the frame 102 and is retained by pins 226. To bridge from a flattened configuration, the corner supports 212 are replaced by bridging supports 184 and bridging members 222 are added to double supports 214. In this manner, the stage can be bridged to support panels 210*d*.

It can also be appreciated that the stage may be converted from a two or three panel flattened stage to a choral riser by replacing the center supports 212 or double supports 214 by supports 218 and 220. The single supports 212 at the uppermost edge of the choral riser are also fitted with a riser 216 to support the stage and a three panel choral riser type arrangement. The choral riser arrangement can then be bridged by mounting bridging members 222 and 184. The stage 100 also converts easily between extended arrangements with different panel widths.

Since the stage 100 is elevationally adjustable and the framework 102 may be adjusted in height, it can be appreciated that an extended choral riser arrangement may be formed whereby stages are bridged and then the height is adjusted so that more than just the three adjacent heights are achieved. In this manner, an extended bleacher arrangement having numerous heights may be achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. An elevationally adjustable folding stage, comprising:

a folding support structure;

removable stage panels attaching to the support structure so as to form a stage surface;

connecting means for connecting the stage panels to the support structure, wherein the connecting means is movable between a first position for connecting first stage panels having a first size and a second position for connecting second stage panels having a second size;

height adjustment means for individually adjusting elevation of each stage panel;

bridging means for supporting panels between adjacent stages at the elevation of each stage panel.

2. A stage according to claim 1, wherein the support structure folds along a center axis, and wherein the stage panels move from a horizontal use position to a folded position wherein the stage panels are substantially vertical.

3. A stage according to claim 1, wherein the bridging means comprises a bridging panel support member attaching to the stage for supporting a bridging panel between adjacent stages.

4. A stage according to claim 3, wherein the panel connecting means includes detachable brackets and wherein the bridging panel support member attaches to the brackets.

5. A stage according to claim 4, wherein each of the brackets includes a plurality of pins extending therefrom, and wherein the bridging panel support member includes a plurality of orifices adapted for sliding over the pins for supporting the support member.

6. A stage according to claim 5, wherein each of the orifices comprises an enlarged lower portion and a smaller upper portion and wherein each of the pins includes a head portion and smaller pin body, wherein the enlarged portion of the orifice slides over the head of the pin and the smaller portion of the orifice engages the pin body to retain the bridging panel support member.

7. A stage according to claim 1, wherein the stage folds along a center line.

8. A stage according to claim 7, wherein the stage panels extend the support structure and wherein the support members extend over the edge of the support structure to support the stage panels.

9. A multi-level folding stage, comprising:

a folding support structure;

removable stage panels attaching to the support structure so as to form a stage surface;

detachable panel height adjustment means for changing elevation of each stage panel independently, wherein first stage panels having a first size are attachable to the support structure and second stage panels having a second size are attachable to the support structure, wherein the height adjustment means are movable to a first position to support the first stage panels and a second position to support the second stage panels.

10. A stage according to claim 9, further comprising means for storing the panels on the folding structure in a folded position.

11. A stage according to claim 9, wherein the stage panel height adjustment means comprise detachable support columns having pins engaging the stage panels mounted thereon, wherein the columns mount on the folding support structure.

12. A stage according to claim 11, wherein the panel height adjustment means further comprises dual columns of different heights mounted as a single element for supporting adjacent panels at different heights.

13. A stage according to claim 11, wherein the panel height adjustment means comprise a saddle type bracket mounting over the support structure, the bracket having a first support column having a first height and a second support column having a second height.

14. A folding stage, comprising:

a pair of first panel members detachably mounting on the stage forming a first stage surface;

three second panel members detachably mounting on the stage forming a second stage surface interchangeable with the first stage surface;

first, second, third and fourth means for supporting panel members, the first and second support means being interchangeable with one another and the third and fourth support means being interchangeable with one another, wherein:

the first interchangeable support means are constructed and arranged to support each of the first panel members at a first height;

the second interchangeable support means are constructed and arranged to support one of the first panel members at the first height and a second of the first panel members higher than the first height;

the third interchangeable support means are constructed and arranged to support each of the second panel members at the first height; and the fourth interchangeable support means are constructed and arranged to support one of the second panel members at the first height, a second of the second panel member at a second height and a third of the second panel members at a third height.

15. A folding stage according to claim 14, further comprising bridging means for supporting the first and second panel members between adjacent stages to form extended stages and riser configurations.

16. A folding stage according to claim 14, wherein the first, second, third and fourth support means comprise detachable support members.

17. A folding stage according to claim 16, wherein the detachable support members mount at different locations on the stage.

* * * * *